US011774876B2

(12) United States Patent
Fukasawa et al.

(10) Patent No.: US 11,774,876 B2
(45) Date of Patent: Oct. 3, 2023

(54) DEVELOPING UNIT

(71) Applicant: CANON KABUSHIKI KAISHA, Tokyo (JP)

(72) Inventors: Yu Fukasawa, Tokyo (JP); Seiya Ishikawa, Kanagawa (JP); Masanari Morioka, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/890,403

(22) Filed: Aug. 18, 2022

(65) Prior Publication Data

US 2023/0061093 A1 Mar. 2, 2023

(30) Foreign Application Priority Data

Aug. 27, 2021 (JP) ..... 2021-139127

(51) Int. Cl.
*G03G 15/08* (2006.01)
*G03G 21/16* (2006.01)

(52) U.S. Cl.
CPC ..... *G03G 15/0817* (2013.01); *G03G 15/0898* (2013.01); *G03G 21/1619* (2013.01)

(58) Field of Classification Search
CPC ..... G03G 15/0817; G03G 15/0898; G03G 21/1619
See application file for complete search history.

(56) References Cited

U.S. PATENT DOCUMENTS 5,488,462 A * 1/1996 Ishikawa ..... G03G 15/0817 399/103
2014/0376954 A1* 12/2014 Uno ..... G03G 15/0898 399/103
2016/0041501 A1* 2/2016 Shoji ..... G03G 15/0817 399/103
2016/0259271 A1* 9/2016 Ooyoshi ..... G03G 15/0817

FOREIGN PATENT DOCUMENTS

JP 2012-118566 A 6/2012
JP 2014-137400 A 7/2014
JP 2016-130788 A 7/2016
JP 2020-086182 A 6/2020

* cited by examiner

*Primary Examiner* — Sandra Brase
(74) *Attorney, Agent, or Firm* — VENABLE LLP

(57) ABSTRACT

A seal member includes a seal surface that comes into contact with and slides with an end portion of an outer circumferential surface of a developing roller. The seal surface includes a first seal region configured of a plurality of first fiber bundles including a first fiber having a charge property that repels a developer, and a second seal region configured of a plurality of second fiber bundles including a second fiber having a charge property that attracts the developer, both extending in an inclined direction such that a portion thereof closer to an opening portion of a frame body of a developing unit is located further downstream in a rotating direction of the developing roller, and being alternately disposed in the rotating direction, and a proportion of a portion occupied by the second fiber bundles on the seal surface is at least 5% and not more than 60%.

9 Claims, 25 Drawing Sheets

DEVELOPING UNIT

BACKGROUND OF THE INVENTION

Field of the Invention

The present disclosure relates to a developing unit provided in an image forming apparatus such as a copier or a printer that adopts an electrophotographic system.

Description of the Related Art

Image forming apparatuses such as copiers or printers that adopt an electrophotographic system include a developing unit for developing, as a toner image, an electrostatic latent image formed on a photosensitive drum serving as an image carrying member. The developing unit includes a developer container (a frame body) including a storage chamber for storing toner serving as a developer, a developer carrying member (a developing roller) that carries and conveys the toner stored in the developer container, and a layer thickness regulating member (a developing blade) that regulates a layer thickness of the toner on the developing roller. The developing unit has a configuration in which it is sealed with a plurality of seal members or the like so that the toner stored in the developer container does not leak to the outside of the developing unit via each of these constituent members.

As a sealing configuration with the seal members, various seal members are disposed to cover a vicinity of a toner supply opening of the developer container. An under-developing blade seal member made of an elastic material such as polyurethane foam is disposed in a gap between the developer container and the developing blade. In addition, flexible end seal members (developing end seals) formed of felt or the like on a surface that rubs against the developing roller, and the like are disposed at both ends in a longitudinal direction of the developer container in gaps between the developer container and a back surface of the developing blade, and between the developer container and a circumferential surface of the developing roller.

Here, a configuration is known in which, by injecting an elastomer resin into various gaps between the seal members, the developer container, the back side of the developing blade, the circumferential surface of the developing roller, and the like, the sealing property is further improved (Japanese Patent Application Laid-open No. 2012-118566). Further, in order to prevent toner that has entered gaps from being melted by frictional heat and fused onto end seal members to impair sealing performance, a technique for achieving the effect of reducing frictional heat at the time of rubbing against a developing roller in end seal members and improving heat dissipation has been proposed (Japanese Patent Application Laid-open No. 2014-137400).

SUMMARY OF THE INVENTION

In order to achieve further speeding up and power saving of an image forming apparatus, in a configuration of a developing unit of a process cartridge, it is required to lower a fixation temperature and perform power saving by further increasing a rotation speed of a developing roller and further lowering a melting point of toner. However, it has not been possible to completely prevent toner from entering between the developing roller and end seal members, and in a case in which the toner that has caught on the end seal members is fused, toner sealing performance of the end seal members cannot be exhibited, which has a problem of causing toner leakage. For this reason, there is a demand for end seal members that ensure better sealing performance. In order to increase the speed of the developing roller and lower the melting point of the toner, it is necessary to further reduce an amount of toner caught on the end seal members and prevent fusion of the toner caught on the end seal members.

Further, in a case in which a cleaner-less system aimed at reducing the number of components and waste is adopted, the transfer residual toner that remains without being transferred from the drum to a transfer member is collected in the developing unit and reused. For this reason, as compared with a developing unit having a conventional configuration having a cleaner, at end portions on the developing roller, toner having a potential different from that inside a developer container, and toner scattered further outward beyond a longitudinal range regulated by a developing blade may be collected. For that reason, in the case of the cleaner-less system, the toner easily enters onto the end seal members as compared with the conventional configuration having a cleaner.

An object of the present invention is to provide a technique in which toner sealing performance of a developing unit provided by a seal member can be further improved.

In order to achieve the above object, a developing unit according to the present invention includes the following:

a frame body including a storage chamber in which a developer is stored, and an opening portion communicating with the storage chamber;

a developing roller rotatably supported by the frame body to rotate around a rotation axis thereof, the developing roller facing the opening portion; and a seal member provided on a portion of the frame body outside the opening portion in the rotation axis direction, the seal member extending along a rotating direction of the developing roller and including a seal surface that comes into contact with and slides with an end portion of an outer circumferential surface of the developing roller in the rotation axis direction, wherein the seal surface includes a first seal region having a stripe shape and a second seal region having a stripe shape, the first seal region includes a plurality of first fiber bundles including a first fiber having a charge property that repels the developer charged with a normal polarity, the second seal region includes a plurality of second fiber bundles including a second fiber having a charge property that attracts the developer charged with a normal polarity, both of the first seal region and the second seal region extend in an inclined direction such that a portion thereof closer to the opening portion in the rotation axis direction is located further downstream in the rotating direction of the developing roller, the first seal region and the second seal region are alternately disposed in the rotating direction, and a proportion of a portion occupied by the second fiber bundles on the seal surface is at least 5% and not more than 60%.

According to the present invention, toner sealing performance of the developing unit provided by the seal member can be further improved.

Further features of the present invention will become apparent from the following description of exemplary embodiments with reference to the attached drawings.

DESCRIPTION OF THE EMBODIMENTS

In the following examples, embodiments according to the present disclosure will be illustratively described. However, the configurations disclosed in the following examples, for example, functions, materials, shapes of components, and their relative arrangements, show an example of a form related to the scope of claims and are not intended to limit the scope of claims to those disclosed in these examples. Further, the problem to be solved by the configurations disclosed in the following examples or the operations or effects obtained from the disclosed configurations are not intended to limit the scope of claims.

EXAMPLE 1

An electrophotographic image forming apparatus according to Example 1 of the present disclosure will be described below with reference to the drawings. Here, the electrophotographic image forming apparatus (hereinafter referred to as an image forming apparatus) forms images on a recording material using an electrophotographic image forming system. Examples of the image forming apparatus include a copier, a facsimile apparatus, a printer (a laser light printer, an LED printer, or the like), a multifunction printer thereof, and the like. The recording material includes a sheet-shaped recording medium such as recording paper and a plastic sheet. Further, the image forming apparatus according to the present example is an image forming apparatus that adopts a so-called cartridge system. The cartridge is a unit that is attachable and detachable to/from the image forming apparatus and has a photosensitive member and process unit (for example, a charging member, a developing member, a cleaning member, and the like) that acts on the photosensitive member. In the following examples, a laser light printer from which four process cartridges (cartridges) are detachable is exemplified as an image forming apparatus. Also, the number of process cartridges mounted on the image forming apparatus is not limited thereto. It may be appropriately set as necessary.

Outline Configuration of Image Forming Apparatus

Figure 1:
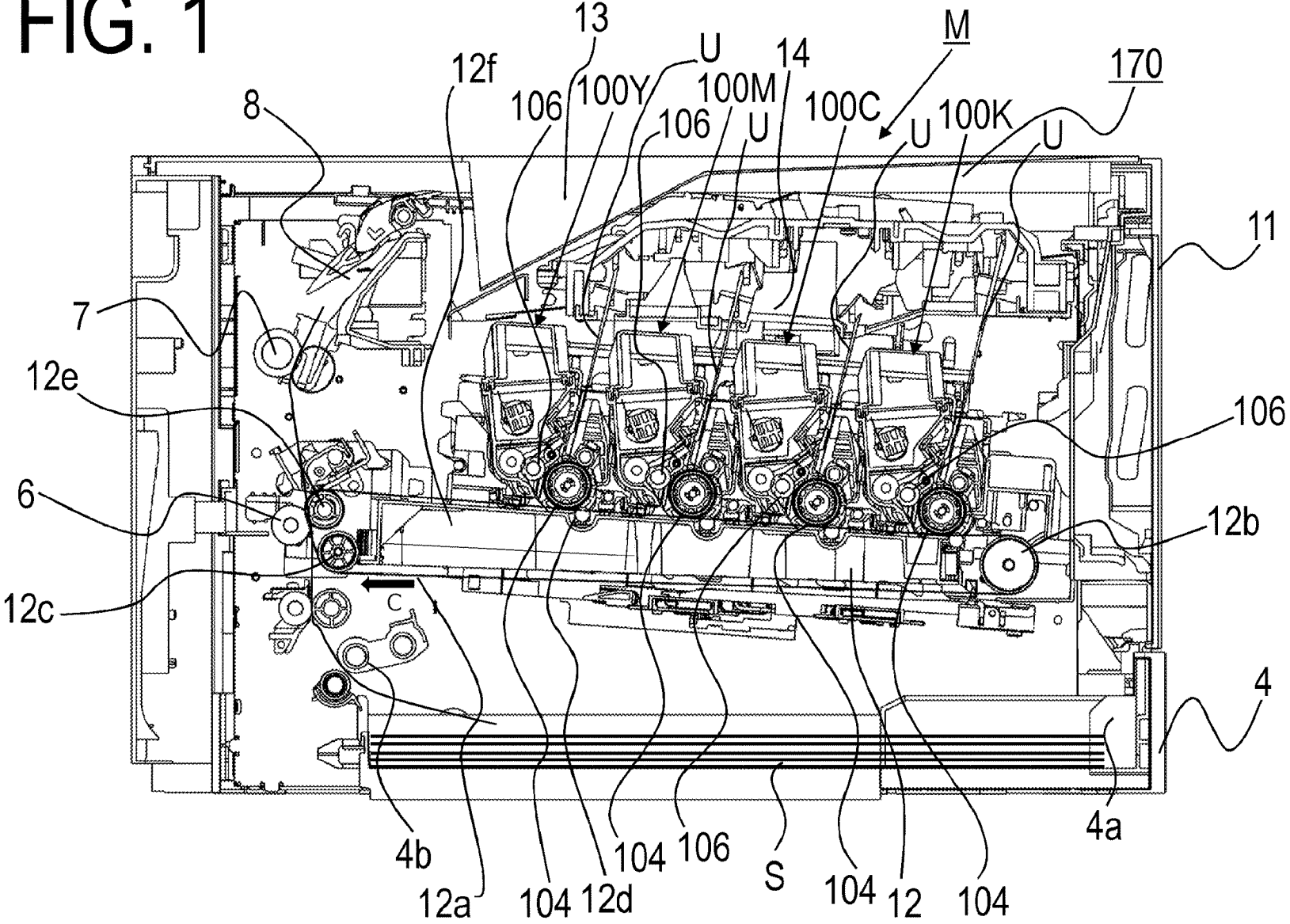
FIG. 1 is a cross-sectional view of an image forming apparatus.
Figure 2:
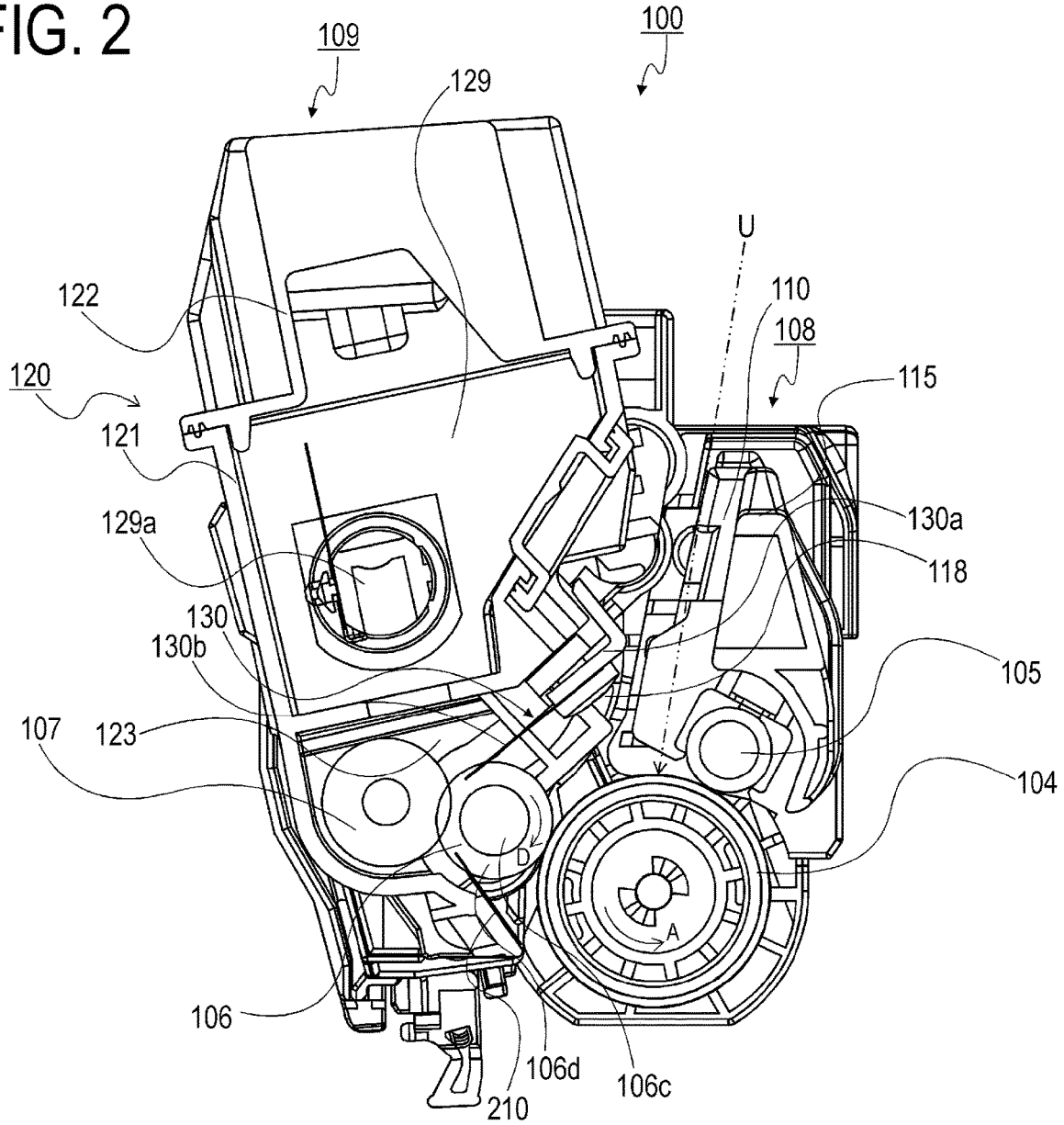
FIG. 2 is a cross-sectional view of a process cartridge.

FIG. 1 is a cross-sectional view schematically showing a configuration of an image forming apparatus M according to the present example. Also, FIG. 2 is a cross-sectional view schematically showing a configuration of a process cartridge 100. The image forming apparatus M is a full four-color laser printer using an electrophotographic process and performs color image formation on recording media S. The image forming apparatus M is a process cartridge type, and the process cartridge 100 is detachably mounted on an image forming apparatus main body (an apparatus main body) 170 to form color images on the recording media S.

Here, in the image forming apparatus M, a side on which a front door 11 is provided is defined as a front side (a front surface), and a surface on a side opposite to the front surface is defined as a back surface (rear surface). In addition, a right side of the image forming apparatus M when viewed from the front is referred to as a driving side, and a left side thereof is referred to as a non-driving side. Further, when the image forming apparatus M is viewed from the front, an upper side thereof is defined as an upper surface and a lower side thereof is defined as a lower surface. FIG. 1 is a cross-sectional view of the image forming apparatus M from the non-driving side, in which a side in front of the paper surface is defined as the non-driving side of the image forming apparatus M, a right side of the paper surface is defined as the front side of the image forming apparatus M, and a side behind the paper surface is defined as the driving side of the image forming apparatus M.

Further, the driving side of the process cartridge 100 is a side on which a drum coupling member (a photosensitive member coupling member), which will be described later, is disposed in an axis direction of a photosensitive drum (an axis direction of a rotation axis of the photosensitive drum). Also, the driving side of the process cartridge 100 is a side on which a developing coupling portion 132*a* (FIG. 10), which will be described later, is disposed in an axis direction of a developing roller (a developing member) (an axis direction of a rotation axis of the developing roller). In addition, the axis direction of the photosensitive drum and the axis direction of the developing roller are parallel, and a longitudinal direction of the process cartridge 100 is also parallel to these.

Four process cartridges 100 (100Y, 100M, 100C, and 100K) are disposed in the apparatus main body 170 (hereinafter, apparatus main body 170) in a substantially horizontal direction. That is, there are four process cartridges: a first process cartridge 100Y, a second process cartridge 100M, a third process cartridge 100C, and a fourth process cartridge 100K.

The first to fourth process cartridges 100 (100Y, 100M, 100C, and 100K) have the same electrophotographic process mechanism, but have developers (hereinafter referred to as toner) having different colors from each other. A rotational driving force is transmitted to the first to fourth process cartridges 100 (100Y, 100M, 100C, and 100K) from a drive output portion (details thereof will be described later) of the apparatus main body 170. Also, a bias voltage (a charging bias, a developing bias, or the like) is supplied from the apparatus main body 170 to each of the first to fourth process cartridges 100 (100Y, 100M, 100C, and 100K).

As shown in FIG. 2, each of the first to fourth process cartridges 100 (100Y, 100M, 100C, and 100K) of the present example has a drum unit 108 that includes a photosensitive drum 104 and a charging portion serving as a process unit that acts on the photosensitive drum 104. Here, the drum unit 108 may have, as process unit, a cleaning portion as well as a charging portion. Further, each of the first to fourth process cartridges 100 (100Y, 100M, 100C, and 100K) has a developing unit 109 including a developing portion for developing an electrostatic latent image on the photosensitive drum 104. A layout of the electrophotographic image forming apparatus in which a plurality of photosensitive drums 104 are arranged substantially in a row in this way is sometimes called an in-line layout or a tandem layout.

In each of the first to fourth process cartridges 100, the drum unit 108 and the developing unit 109 are coupled to each other. A more specific configuration of the process cartridges 100 will be described later.

The first process cartridge 100Y contains yellow (Y) toner in a developer container 120 and forms a yellow toner image on a surface of the photosensitive drum 104. The second process cartridge 100M contains magenta (M) toner in a developer container 120 and forms a magenta-colored toner image on a surface of the photosensitive drum 104. The third process cartridge 100C contains a cyan (C) toner in a developer container 120 and forms a cyan-colored toner image on a surface of the photosensitive drum 104. The fourth process cartridge 100K contains black (K) toner in a developer container 120 and forms a black toner image on a surface of the photosensitive drum 104.

As shown in FIG. 1, a laser scanner unit 14 serving as an exposure unit is provided above the first to fourth process cartridges 100 (100Y, 100M, 100C, and 100K). The laser scanner unit 14 outputs laser light U in response to image information. Then, the laser light U passes through an exposure window 110 (see FIG. 2) of the process cartridge 100 and scans and exposes the surface of the photosensitive drum 104.

An intermediate transfer unit 12 serving as a transfer member is provided below the first to fourth process cartridges 100 (100Y, 100M, 100C, and 100K). The intermediate transfer unit 12 has a drive roller 12*e*, a turn roller 12*c*, and a tension roller 12*b*, and a flexible transfer belt 12*a* is hung thereon. A lower region of a circumferential surface of the photosensitive drum 104 of each of the first to fourth process cartridges 100 (100Y, 100M, 100C, and 100K) is in contact with an upwardly facing region of an outer circumferential surface of the annular transfer belt 12*a*. The contact portion is a primary transfer portion. A primary transfer roller 12*d* is provided on an inner side of the transfer belt 12*a* to face the photosensitive drum 104. A secondary transfer roller 6 abuts the turn roller 12*c* via the transfer belt 12*a*. A contact portion between the transfer belt 12*a* and the secondary transfer roller 6 is a secondary transfer portion.

A feeding unit 4 is provided below the intermediate transfer unit 12. The feeding unit 4 has a paper feeding tray 4*a*, in which a recording medium S is loaded and stored, and a paper feeding roller 4*b*. A conveyance path of the recording medium S is configured to be directed substantially upward from the feeding unit 4 on a back surface side of the apparatus in the apparatus main body 170.

A fixing apparatus 7 and a paper discharging apparatus 8 are provided on a downstream side of the secondary transfer portion (on an upper left side in the apparatus main body 170 in FIG. 1) in the conveyance path of the recording media S. An upper surface of the apparatus main body 170 is formed as a paper discharging tray 13. The recording media S are heated and pressurized by a fixing portion provided in the fixing apparatus 7 to fix toner images thereon and is discharged to the paper discharging tray 13.

Image Forming Operation

An operation for forming a full color image is as follows. The photosensitive drum 104 of each of the first to fourth process cartridges 100 (100Y, 100M, 100C, and 100K) is rotationally driven at a predetermined speed (in a direction of arrow A in FIG. 2). The transfer belt 12*a* is also rotationally driven in a forward direction (in a direction of arrow C in FIG. 1) with respect to the rotation of the photosensitive drum 104 at a speed corresponding to the speed of the photosensitive drum 104.

The laser scanner unit 14 is also driven. In synchronization with the drive of the laser scanner unit 14, a charging roller 105 uniformly charges the surface of the photosensitive drum 104 to a predetermined polarity and potential in each process cartridge 100. The laser scanner unit 14 scans and exposes the surface of each photosensitive drum 104 with laser light U in accordance with an image signal of each color. Thus, an electrostatic latent image corresponding to the image signal of the corresponding color is formed on the surface of each photosensitive drum 104. The formed electrostatic latent image is developed by a developing roller 106 that is rotationally driven at a predetermined speed. Due to such an electrophotographic image forming process operation, a yellow toner image corresponding to a yellow component of the full color image is formed on the photosensitive drum 104 of the first process cartridge 100Y. Then, the toner image is primarily transferred onto the transfer belt 12*a*.

Similarly, a magenta-colored toner image corresponding to a magenta component of the full color image is formed on the photosensitive drum 104 of the second process cartridge 100M. Then, the toner image is superimposed and primarily transferred on the yellow toner image already transferred on the transfer belt 12*a*. Similarly, a cyan-colored toner image corresponding to a cyan component of the full color image is formed on the photosensitive drum 104 of the third process cartridge 100C. Then, the toner image is superimposed and primarily transferred on the yellow and magenta-colored toner images already transferred on the transfer belt 12*a*. Similarly, a black toner image corresponding to a black component of the full color image is formed on the photosensitive drum 104 of the fourth process cartridge 100K. Then, the toner image is superimposed and primarily transferred on the yellow, magenta-colored, and cyan-colored toner images already transferred on the transfer belt 12*a*. In this way, an unfixed full four-color toner image of yellow, magenta, cyan, and black is formed on the transfer belt 12*a*.

On the other hand, the recording media S are separated and fed one by one at predetermined control timings. The recording media S are introduced into the secondary transfer portion, which is the contact portion between the secondary transfer roller 6 and the transfer belt 12*a*, at predetermined control timings. Thus, in the process of conveying the recording media S to the secondary transfer portion, the toner images on the transfer belt 12*a*, on which the four colors are superimposed, are sequentially and collectively transferred to surfaces of the recording media S. After that, the recording media S are conveyed to the fixing apparatus 7 to fix the toner images on the recording media S, and then are discharged to the paper discharging tray 13.

Outline of Configuration of Attaching and Detaching Process Cartridge

Figure 3:
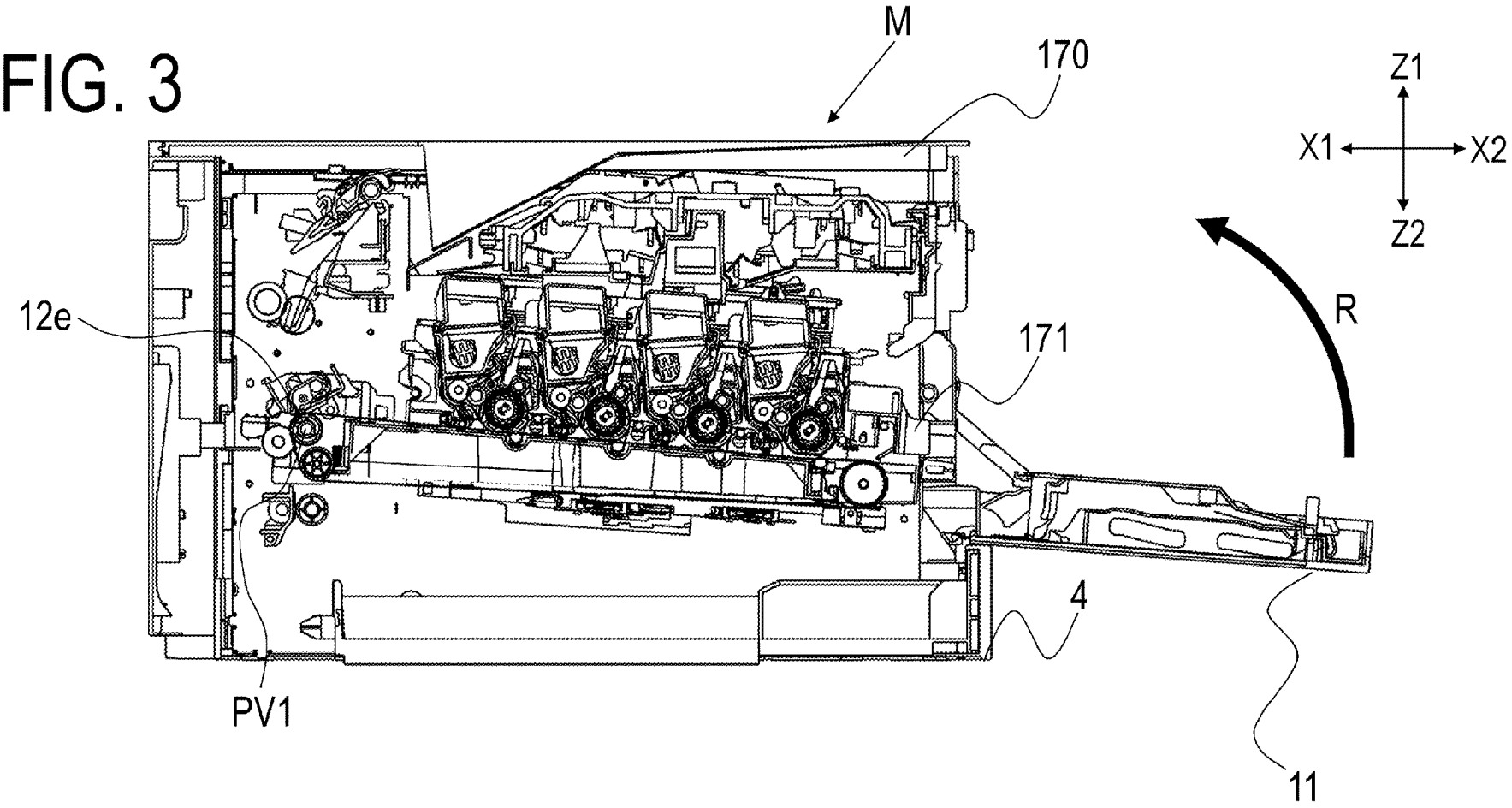
FIG. 3 is a cross-sectional view of the image forming apparatus.
Figure 4:
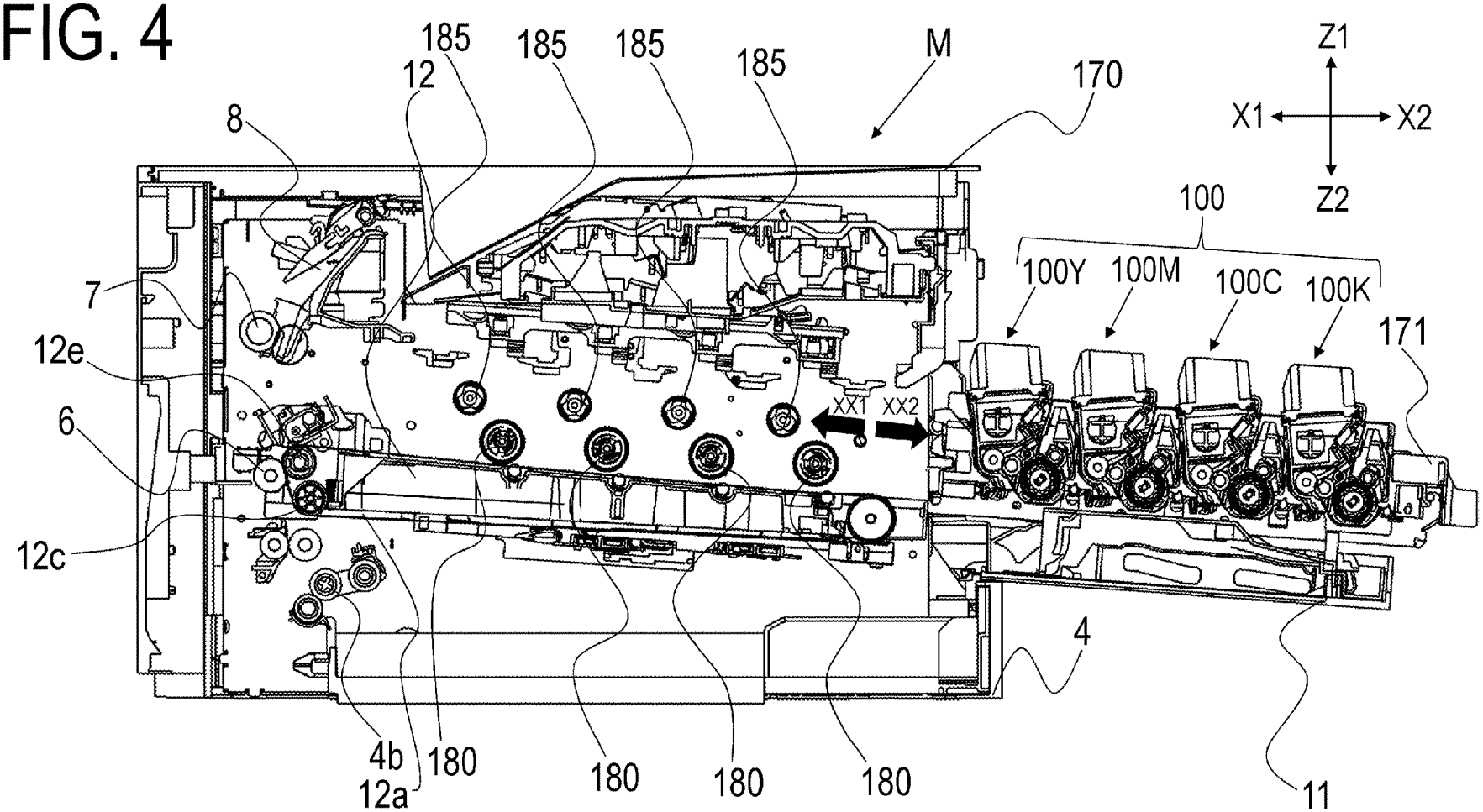
FIG. 4 is a cross-sectional view of the image forming apparatus.
Figure 5:
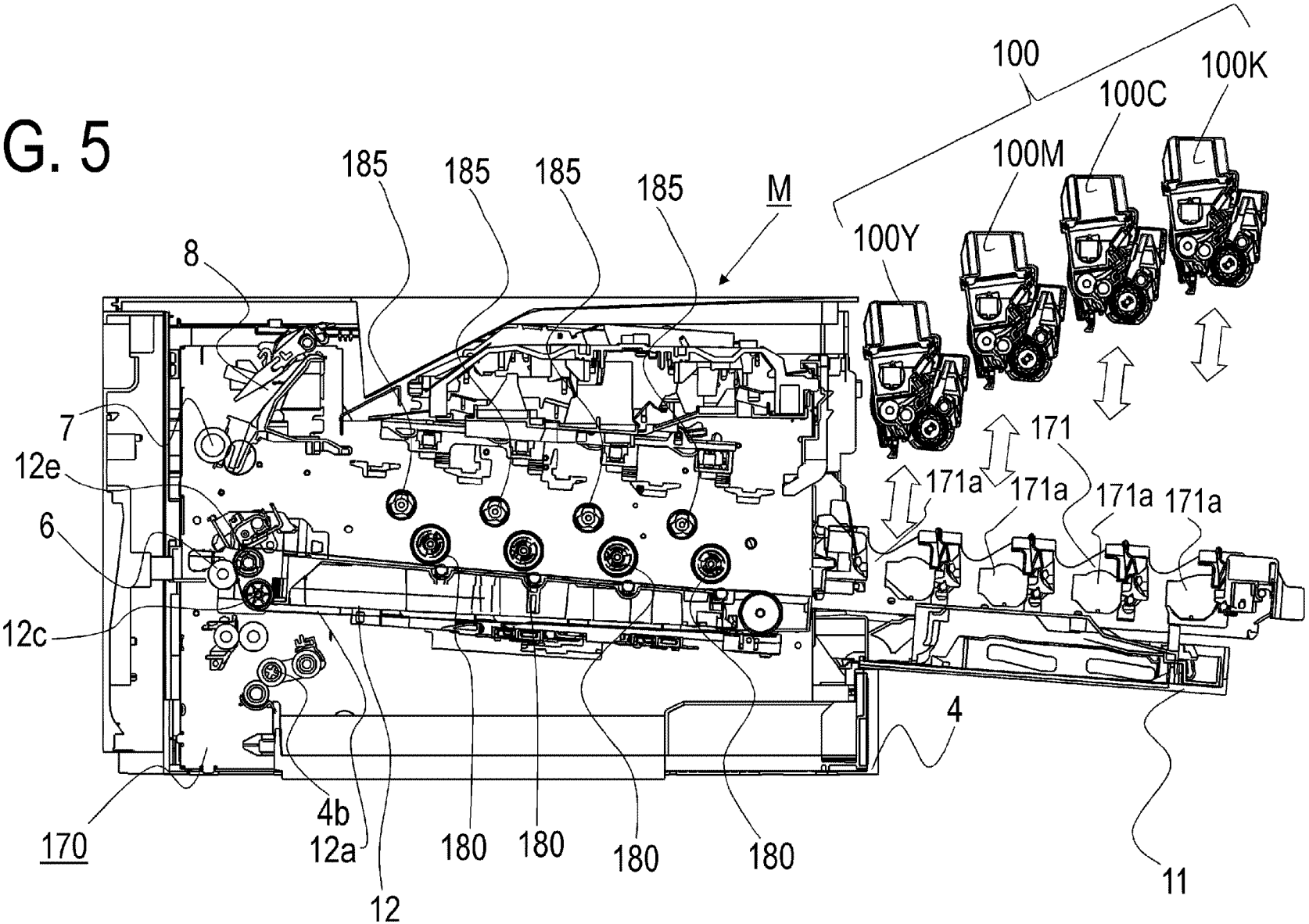
FIG. 5 is a cross-sectional view of the image forming apparatus.
Figure 6B:
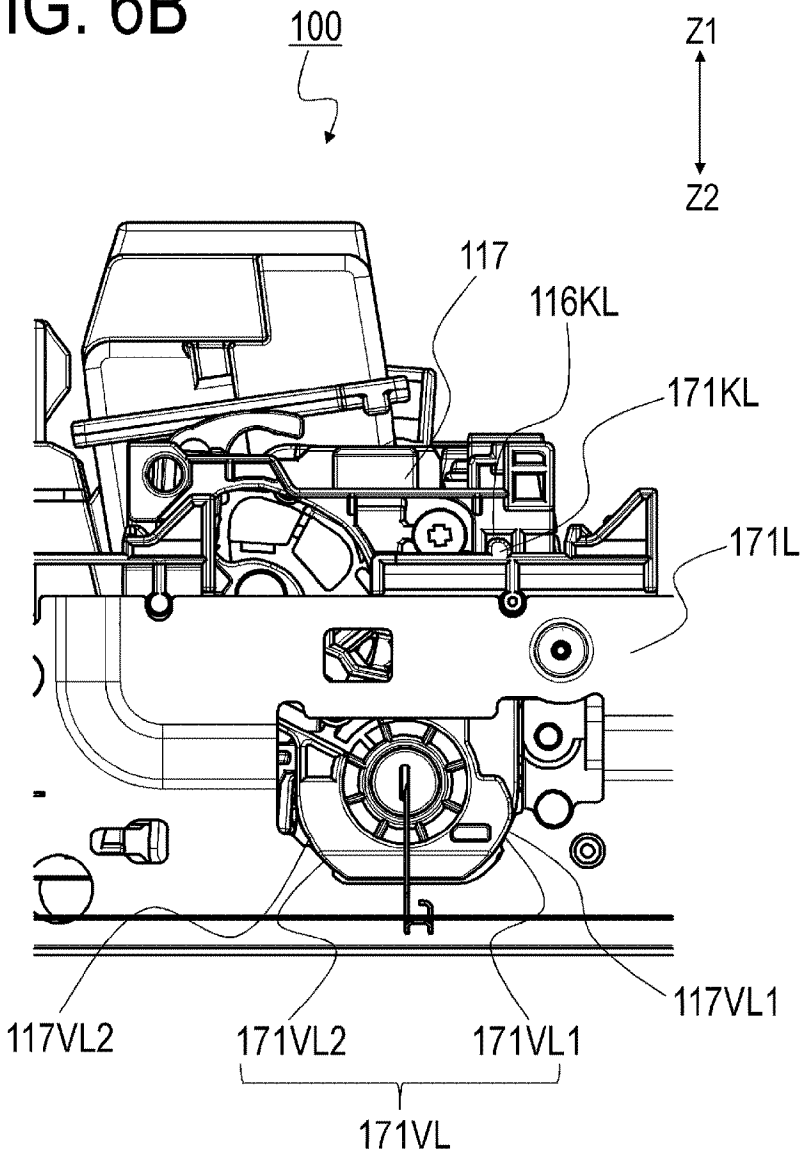
FIGS. 6A and 6B are partially enlarged views of a tray.
Figure 6A:
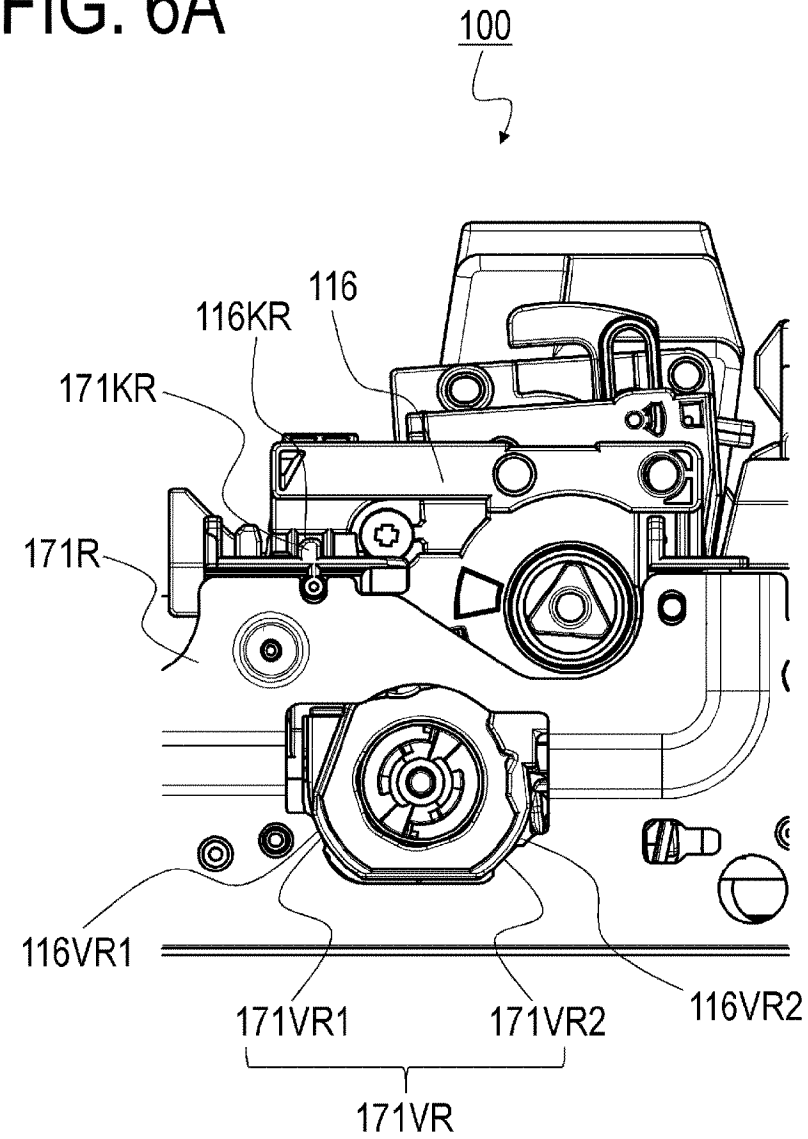

A tray (hereinafter referred to as a tray) 171 for supporting the process cartridges will be described in more detail with reference to FIGS. 1, and 3 to 6A and 6B. FIG. 3 is a cross-sectional view of the image forming apparatus M in which the tray 171 is located inside the apparatus main body 170 with the front door 11 open. FIG. 4 is a cross-sectional view of the image forming apparatus M in a state in which the tray 171 is located outside the apparatus main body 170 and the process cartridges 100 are housed inside the tray 171 with the front door 11 open. FIG. 5 is a cross-sectional view of the image forming apparatus M in a state in which the tray 171 is located outside the apparatus main body 170 and the process cartridges 100 are removed from the tray 171 with the front door 11 open. FIG. 6A is a partial detailed view of the tray 171 from the driving side in the state of FIG. 3. FIG. 6B is a partial detailed view of the tray 171 from the non-driving side in the state of FIG. 3.

As shown in FIGS. 3 and 4, the tray 171 is movable relative to the apparatus main body 170 in a direction of arrow X1 (a pushing direction) and a direction of arrow X2 (a pulling direction), which are a front to rear direction of the apparatus. That is, the tray 171 is provided to be able to be pulled out and pushed into the apparatus main body 170, and the tray 171 is configured to be movable in the substantially horizontal direction in a state in which the apparatus main body 170 is installed on a horizontal plane. Here, the state in which the tray 171 is located outside the apparatus main body 170 (the state of FIG. 4) is referred to as an outer position. In addition, the state in which the tray 171 is located inside the apparatus main body 170 with the front door 11 open and the photosensitive drum 104 and the transfer belt 12*a* are separated from each other (the state of FIG. 3) is referred to as an inner position.

Further, the tray 171 has mounting portions 171*a* in which the process cartridges 100 can be detachably mounted as shown in FIG. 5 at the outer position. Then, as shown in FIGS. 6A and 6B, each process cartridge 100 mounted on the mounting portion 171*a* at the outer position of the tray 171 is supported on the tray 171 by a driving side cartridge cover member 116 and a non-driving side cartridge cover member 117. Then, the process cartridges 100 move to the inside of the apparatus main body 170 with the movement of the tray 171 in a state in which they are disposed in the mounting portions 171*a*. In this case, they move with gaps between the transfer belt 12*a* and the photosensitive drums 104. For this reason, the tray 171 can move the process cartridges 100 to the inside of the apparatus main body 170 without the photosensitive drums 104 coming into contact with the transfer belt 12*a* (details thereof will be described later).

As described above, the tray 171 allows the plurality of process cartridges 100 to be collectively moved to positions at which images can be formed in the apparatus main body 170 and can be collectively pulled out to the outside of the apparatus main body 170.

Positioning of Process Cartridge

Positioning of the process cartridge 100 with respect to the apparatus main body 170 will be described in more detail with reference to FIGS. 6A and 6B. As shown in FIGS. 6A and 6B, the tray 171 has a right tray portion 171R that supports the driving side (a longitudinally right side) of the process cartridge 100, and a left tray portion 171L that supports the non-driving side (a longitudinally left side). The right tray portion 171R and the left tray portion 171L are respectively provided with positioning portions 171VR and 171VL for holding the process cartridge 100. The positioning portion 171VR has straight portions 171VR1 and 171VR2.

As shown in FIG. 6A, it is configured such that a center of the photosensitive drum is determined by arc portions 116VR1 and 116VR2 of the driving side cartridge cover member 116 coming into contact with the straight portions 171VR1 and 171VR2. Also, as shown in FIG. 6A, the right tray portion 171R has a rotation determining protruded portion 171KR. As shown in FIG. 6A, a posture of the process cartridge 100 is determined with respect to the apparatus main body 170 by fitting the rotation determining protruded portion 171KR with a rotation determining depressed portion 116KR of the driving side cartridge cover member 116.

The positioning portion 171VL and a rotation determining protruded portion 171KL are disposed at positions (on the non-driving side) facing each other with the transfer belt 12*a* interposed therebetween in the longitudinal direction of the positioning portion 171VR and the process cartridge 100. The positioning portion 171VL has straight portions 171VL1 and 171VL2. As shown in FIG. 6B, it is configured such that a center of the photosensitive drum is determined by arc portions 117VL1 and 117VL2 of the non-driving side cartridge cover member 117 coming into contact with the straight portions 171VL1 and 171VL2. Further, as shown in FIG. 6B, the left tray portion 171L has the rotation determining protruded portion 171KL. As shown in FIG. 6B, a posture of the process cartridge 100 is determined with respect to the apparatus main body 170 by fitting the rotation determining protruded portion 171KL with a rotation determining depressed portion 117KL of the non-driving side cartridge cover member 117.

With the above configuration, the position of the process cartridge 100 is correctly determined with respect to the tray 171. Then, as shown in FIG. 4, the process cartridge 100 integrated with the tray 171 is moved in the direction of arrow X1 and inserted to the position shown in FIG. 3. Then, by closing the front door 11 in a direction of arrow R, the process cartridge 100 is pressed by a cartridge pressing mechanism (not shown), which will be described later, and is fixed to the apparatus main body 170 together with the tray 171. Further, in conjunction with the operation of the cartridge pressing mechanism, the transfer belt 12*a* comes into contact with the photosensitive drum 104 serving as a photosensitive member. By being set to this state, it is in a state in which an image is formed (FIG. 1).

Also, in the present example, since the positioning portion 171VR and the positioning portion 171VL also serve as reinforcements for maintaining rigidity in a pulling out operation of the tray 171, they are manufactured by metal sheet metal, but the present invention is not limited thereto.

Cartridge Pressing Mechanism

Figure 7A:
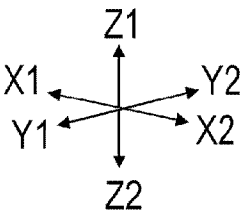
FIGS. 7A and 7B are perspective views of a storage element pressing unit and a cartridge pressing unit.
Figure 7A:
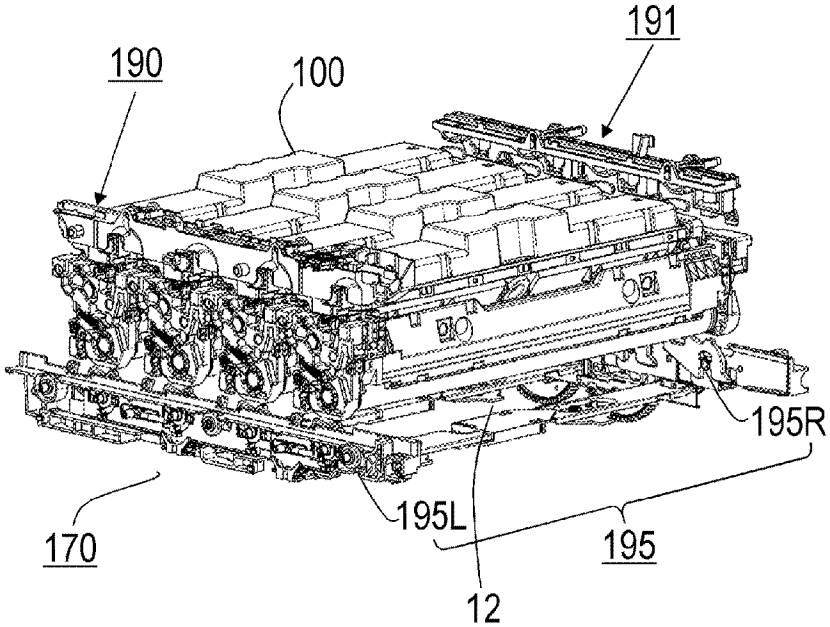
Figure 7B:
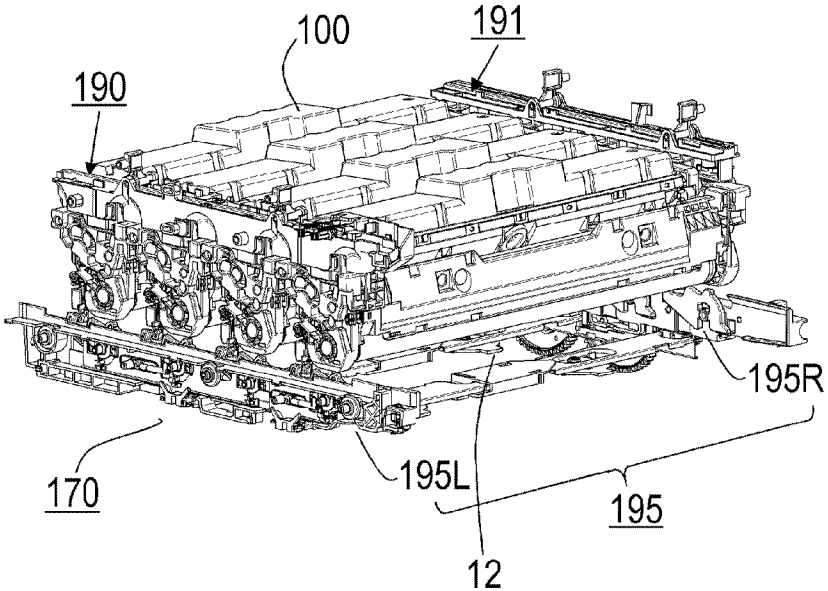

Details of the cartridge pressing mechanism will be described with reference to FIGS. 7A, 7B, and 13. FIG. 7A is a perspective view showing only the process cartridge 100, the tray 171, cartridge pressing mechanisms 190 and 191, and the intermediate transfer unit 12 in a state in which the front door 11 is open as shown in FIG. 3. FIG. 7B is a perspective view showing only the process cartridge 100, the tray 171, the cartridge pressing mechanisms 190 and 191, and the intermediate transfer unit 12 in a state in which the front door 11 is closed as shown in FIG. 1.

Here, the process cartridge 100 receives a driving force during image formation and further receives a reaction force from the primary transfer roller 12*d* (FIG. 1) in the direction of arrow Z1 as well. For that reason, it is required to press the process cartridge in the Z2 direction in order to maintain a stable posture without the process cartridge floating from the positioning portions 171VR and 171VL (see FIGS. 6A and 6B) during the image forming operation. In order to achieve this, in the present example, the apparatus main body 170 is provided with the cartridge pressing mechanisms 190 and 191. In the cartridge pressing mechanisms 190 and 191, a storage element pressing unit 190 is responsible for the non-driving side, and a cartridge pressing unit 191 is responsible for the driving side. This will be described in more detail below.

By closing the front door 11 as shown in FIG. 3, the storage element pressing unit 190 and the cartridge pressing unit 191 shown in FIGS. 7A and 7B descend in a direction of arrow Z2. The storage element pressing unit 190 mainly has a main body side electric contact (not shown) that comes into contact with an electric contact of a storage element (not shown) provided in the process cartridge 100. It is configured such that, by interlocking with the front door 11 using a link mechanism (not shown), the storage element 140 and the main body side electric contact can be contacted and non-contacted. That is, the contacts are configured to abut each other by closing the front door 11 and to be separated from each other by opening the front door 11. With the above configuration, it is configured such that, when the process cartridge 100 moves inside the image forming apparatus main body together with the tray 171, the electric contacts are not rubbed and the contacts are retracted from an insertion and removal locus of the process cartridge 100, and thus insertion and removal of the tray 171 is not hindered. The storage element pressing unit 190 also plays a role of pressing the process cartridge 100 against the positioning portion 171VR described above. In addition, similarly to the storage element pressing unit 190, the cartridge pressing unit 191 also descends in the direction of arrow Z2 in conjunction with the operation of closing the front door 11 and plays a role of pressing the process cartridge 100 against the positioning portion 171VL described above. Further, although the details will be described later, the cartridge pressing mechanisms 190 and 191 also play a role of pressing down moving members 152L and 152R (a moving member 152L is not shown) of the process cartridge 100, which will be described later.

Drive Transmission Mechanism

Figure 8B:
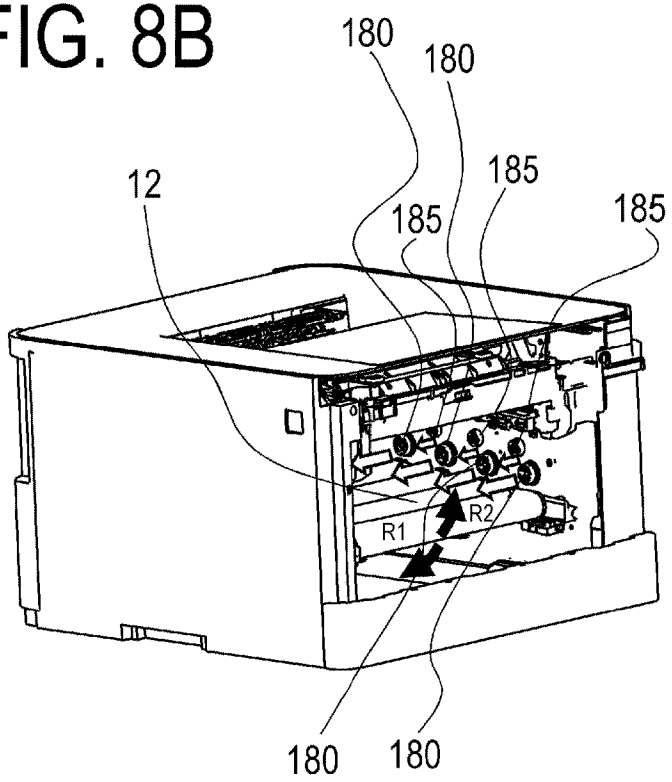
FIGS. 8A and 8B are perspective views of the image forming apparatus.
Figure 8A:
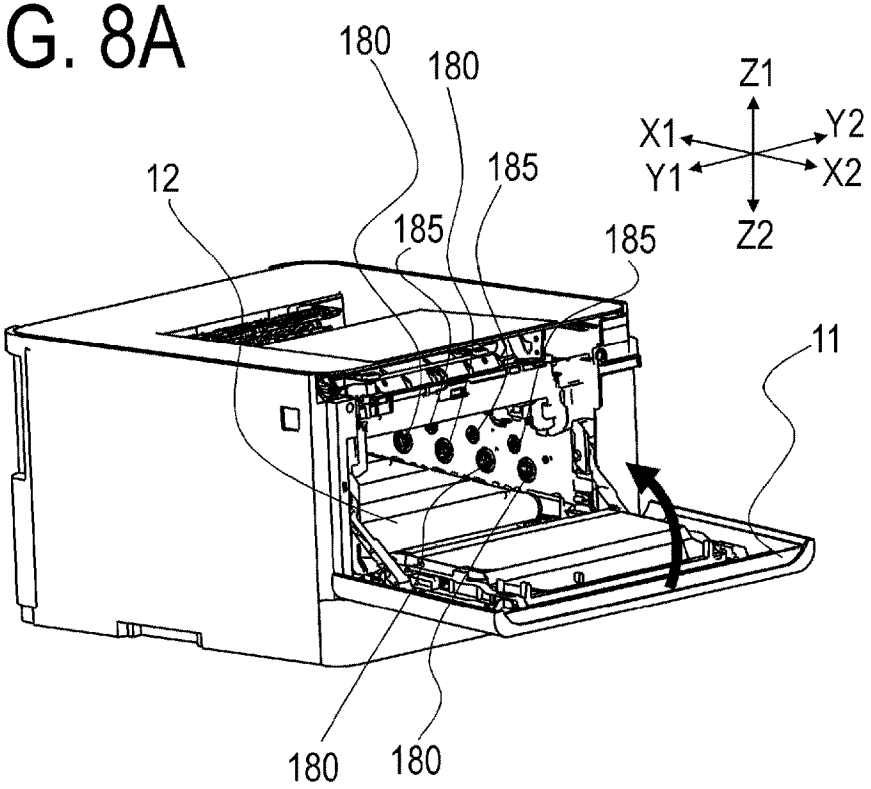
Figure 9:
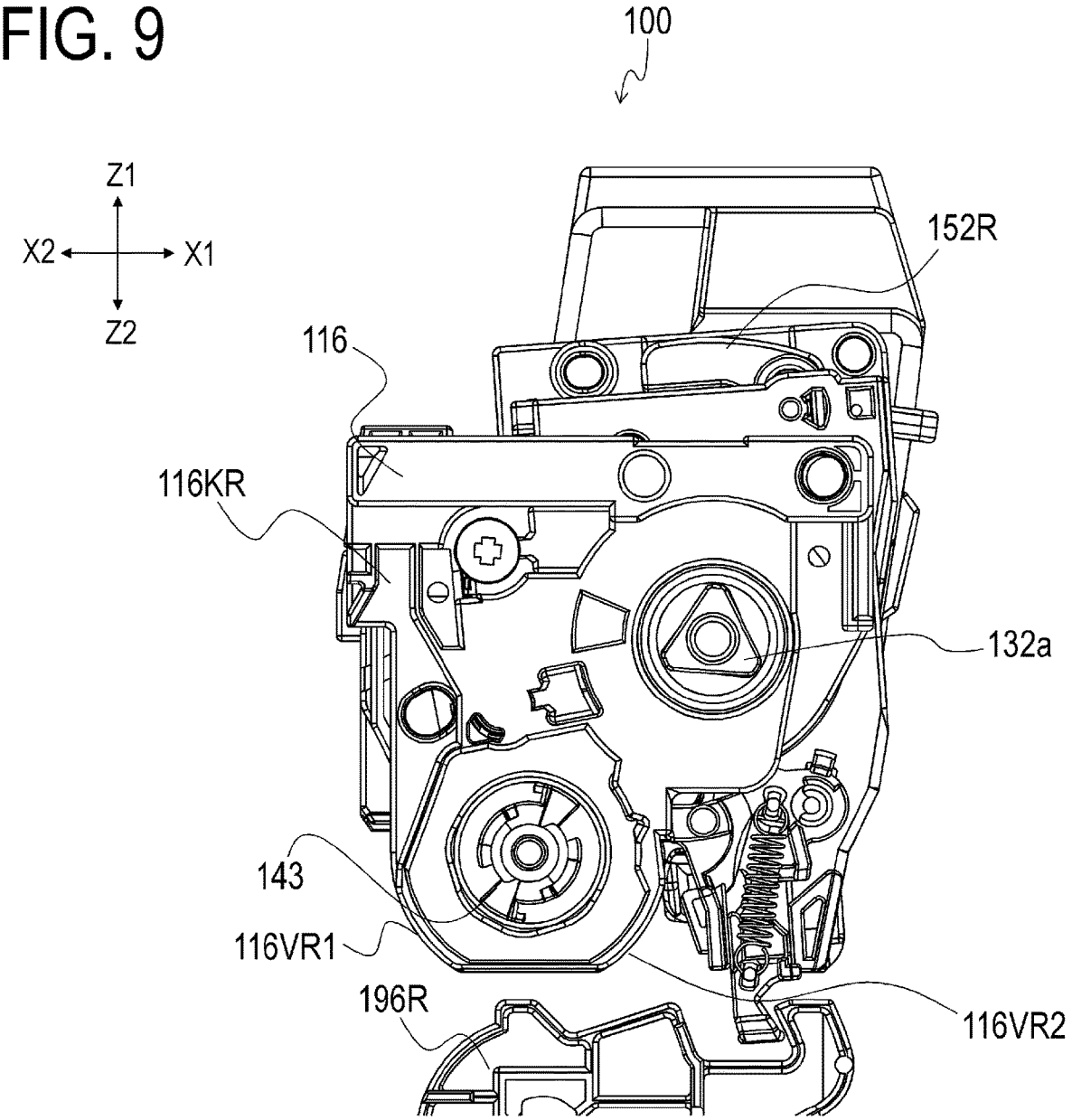
FIG. 9 is a side view of the process cartridge.

A drive transmission mechanism of the main body in the present example will be described with reference to FIGS. 8A, 8B, and 9. FIG. 8A is a perspective view of the state of FIG. 3 or 4 in which illustration of the process cartridge 100 and the tray 171 is omitted. FIG. 8B is a perspective view of the state of FIG. 2 in which illustration of the process cartridge 100, the front door 11, and the tray 171 are omitted. FIG. 9 is a side view of the process cartridge 100 from the driving side and shows a state in which the moving member 152R of the process cartridge 100 is pressed down by a cartridge pressing mechanism (not shown) and engages with a separation control member 196R to overlap each other, which will be described later.

As shown in FIG. 9, the process cartridge in the present example has a developing coupling portion (a rotational driving force receiving portion) 132*a* and a drum coupling member (a photosensitive member coupling member) 143. It is configured such that, by closing the front door 11 (the state of FIG. 8B), a main body side drum drive coupling 180 and a main body side developing drive coupling 185, which transmits the drive to the process cartridge 100, protrude in a direction of arrow Y1 due to a link mechanism (not shown). Further, it is configured such that, by opening the front door 11 (the state of FIG. 8A), the main body side drum drive coupling 180 and the main body side developing drive coupling 185 retract in a direction of arrow Y2. It is configured such that, by retracting each coupling from the insertion and removal locus (X1 and X2 directions) of the process cartridge, the above-mentioned insertion and removal of the tray 171 is not hindered.

By closing the front door 11 and starting the drive of the apparatus main body 170, the above-mentioned main body side drum drive coupling 180 engages with the drum coupling member 143. Further, the main body side developing drive coupling 185 engages with the developing coupling portion 132*a*, and the drive is transmitted to the process cartridge 100. Also, the drive transmission to the process cartridge 100 is not limited to two places as described above, and a mechanism in which the drive is input only to the drum coupling and the drive is transmitted to the developing roller therefrom may be provided.

Configuration of Intermediate Transfer Unit

The intermediate transfer unit 12 of the image forming apparatus main body in the present example will be described with reference to FIGS. 8A and 8B. In the present example, the intermediate transfer unit 12 is configured to ascend in a direction of arrow R2 due to a link mechanism (not shown) by closing the front door 11 and move to the position at the time of image formation (a position at which the photosensitive drum 104 and the transfer belt 12*a* come into contact with each other). Further, by opening the front door 11, the intermediate transfer unit 12 descends in a direction of arrow R1, and the photosensitive drum 104 and the transfer belt 12*a* are separated from each other. That is, in a state in which the process cartridge 100 is set in the tray 171, the photosensitive drum 104 and the transfer belt 12*a* are separated from each other and abut each other in accordance with opening and closing operations of the front door 11.

Also, the abutment and separation operations are configured to cause the intermediate transfer unit 12 to ascend and descend while drawing a rotation locus centered on a center point PV1 shown in FIG. 3. Further, the transfer belt 12*a* is driven by receiving a force from a gear (not shown) disposed coaxially with the PV1. For that reason, by setting the above-mentioned position PV1 as the rotation center, the intermediate transfer unit 12 can ascend and descend without moving a center of the gear. This eliminates the need to move the center of the gear and makes it possible to maintain a position of the gear with high accuracy.

With the above configuration, when the tray 171 is inserted or removed with the process cartridge 100 set in the tray 171, the photosensitive drum 104 and the transfer belt 12*a* do not slide, and image deterioration due to scratches on the photosensitive drum 104 and charging memories is prevented.

Development Separation Control Unit

Figure 10:
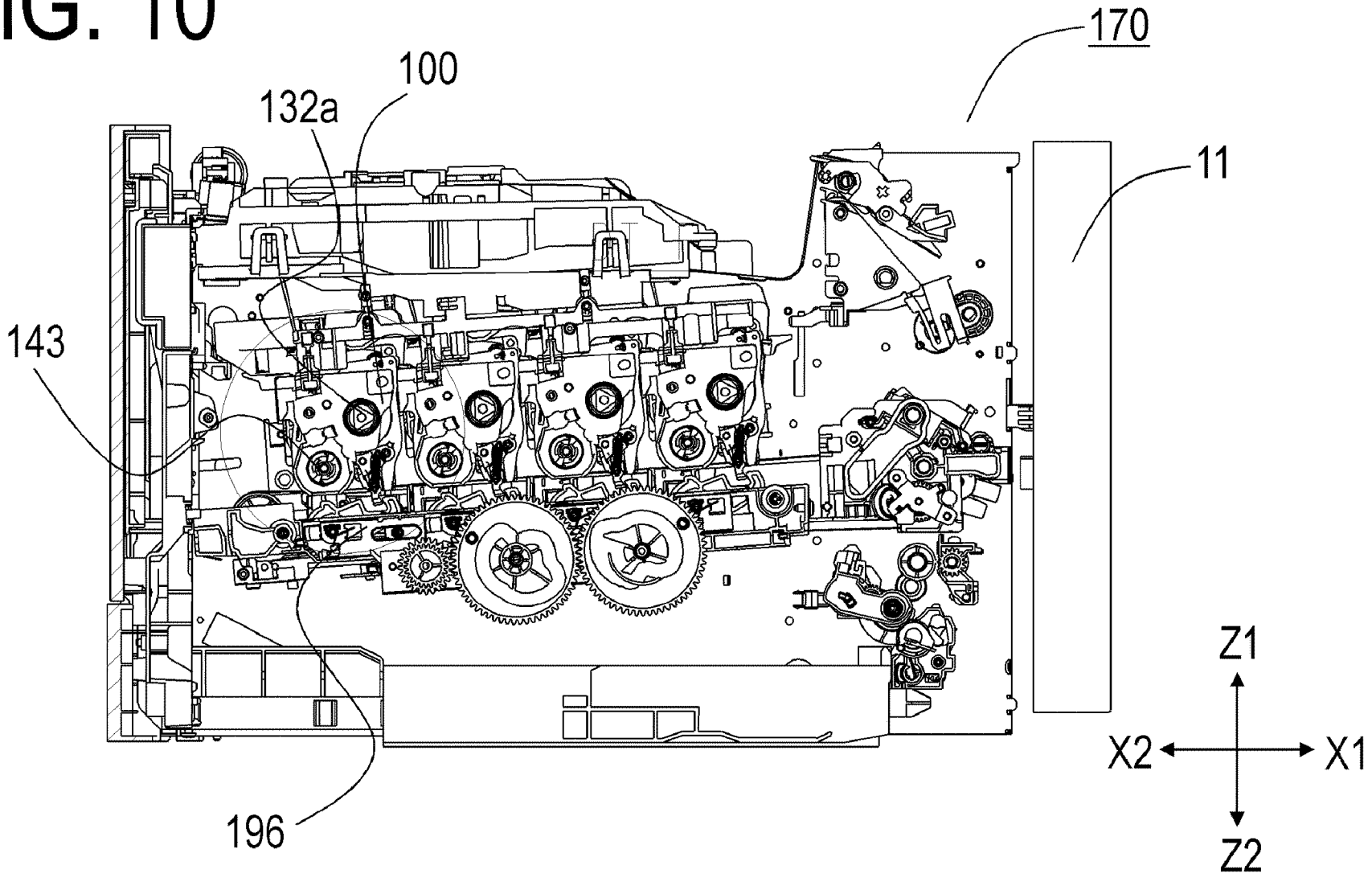
FIG. 10 is a cross-sectional view of the image forming apparatus.
Figure 11B:
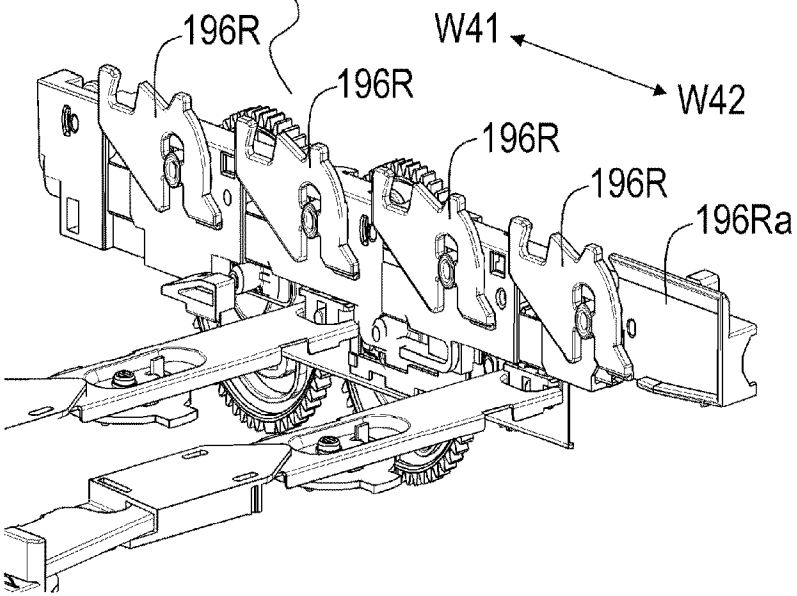
FIGS. 11A and 11B are perspective views of a development separation control unit.
Figure 11A:
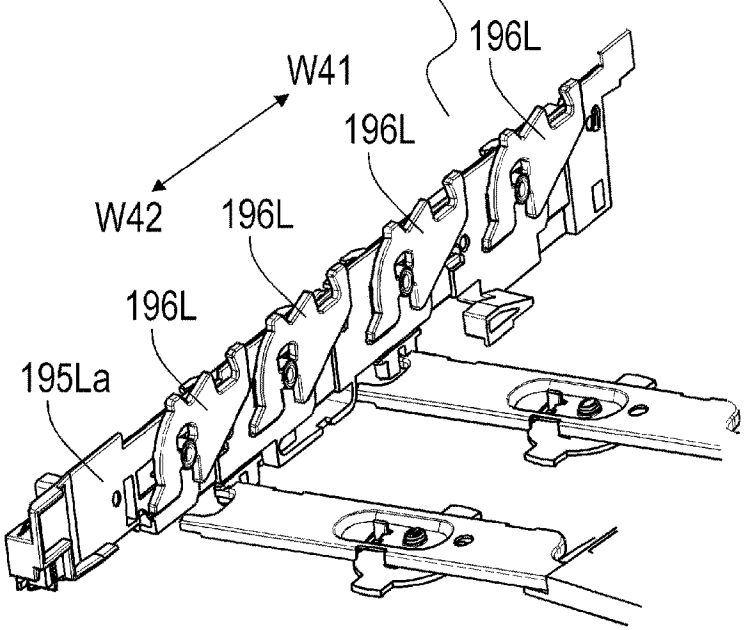

A separation mechanism of the image forming apparatus main body in the present example will be described with reference to FIGS. 7A, 7B, 10, 11A, and 11B. FIG. 10 is a cross-sectional view of the image forming apparatus M cut at a driving side end face of the process cartridge 100. FIGS. 11A and 11B are perspective views of the development separation control unit from diagonally above. In the present example, the development separation control unit 195 controls separation and abutment operations of the developing unit 109 with respect to the photosensitive drum 104 by being engaged with a part of the developing unit 109. As shown in FIGS. 7A and 7B, the development separation control unit 195 is located below the apparatus main body 170. Specifically, the development separation control unit 195 is disposed below the developing coupling portion 132*a* and the drum coupling member 143 in a vertical direction (downward in the direction of arrow Z2). Further, the development separation control unit 195 is disposed on both sides of the intermediate transfer unit 12 in a longitudinal direction (Y1 and Y2 directions) of the photosensitive drum 104. That is, the development separation control unit 195 has a development separation control unit 195R on the driving side and a development separation control unit 195L on the non-driving side.

The development separation control unit 195R has four separation control members (force applying members) 196R corresponding to the process cartridges 100 (100Y, 100M, 100C, and 100K). The four separation control members have substantially the same shape. A fixing plate 195Ra is always fixed to the image forming apparatus main body. The separation control member 196R is configured to be movable in W41 and W42 directions by a control mechanism (not shown). The W41 and W42 directions are substantially parallel to an arrangement direction of the process cartridges 100 mounted on the apparatus main body 170. Similarly to the development separation control unit 195R, the development separation control unit 195L has four separation control members (force applying members) 196L corresponding to the process cartridges 100 (100Y, 100M, 100C, and 100K). The four separation control members have substantially the same shape. A fixing plate 195La is always fixed to the image forming apparatus main body. The separation control member 196L is configured to be movable in W41 and W42 directions by a control mechanism (not shown).

Further, the development separation control unit 195 needs to engage with a part of the developing unit 109 in order to control the separation and contact operations of the developing unit 109. For that reason, it is required that a part of the development separation control unit 195 and a part of the developing unit 109 overlap each other in the vertical direction (Z1 and Z2 directions) (see FIG. 9). Accordingly, after the process cartridge 100 is inserted in the X1 direction, in order to overlap in the vertical direction (Z1, Z2 direction) as described above, it is required to cause a part of the developing unit 109 (the moving members 152L and 152R in the case of the present example) to protrude in the Z2 direction. In addition, in a case in which the entire development separation control unit 195 is raised in the same manner as the intermediate transfer unit 12 described above in order to be engaged, there are problems such as an increase in operating force of the interlocking front door 11 and a complicated drive train. In the present example, one of the reasons for adopting a method in which the development separation control unit 195 is fixed to the apparatus main body 170, and a part of the developing unit 109 (the moving members 152L and 152R) is caused to protrude downward (Z2) in the apparatus main body 170 is to meet this issue. Further, as a mechanism for causing the moving members 152L and 152R to protrude, the mechanisms of the storage element pressing unit 190 and the cartridge pressing unit 191 described above are used as they are, and thus there is no problem as described above, and an increase in the cost of the apparatus main body can be inhibited.

Also, the entire unit of the development separation control unit 195 is fixed to the apparatus main body 170. On the other hand, a part of the development separation control unit 195 has a movable configuration in order to execute an operation in which the developing unit 109 engages with the moving members 152L and 152R to be in a separated state (a separated position or a retracted position) and an abutted state (an abutted position) with respect to the photosensitive drum 104.

As described above, although the detailed description has been omitted, the development separation control unit is configured to abut and separate the developing roller 106 and the photosensitive drum 104 with and from each other by acting on the moving members 152L and 152R of the developing unit 109.

Overall Configuration of Process Cartridge

Figure 12:
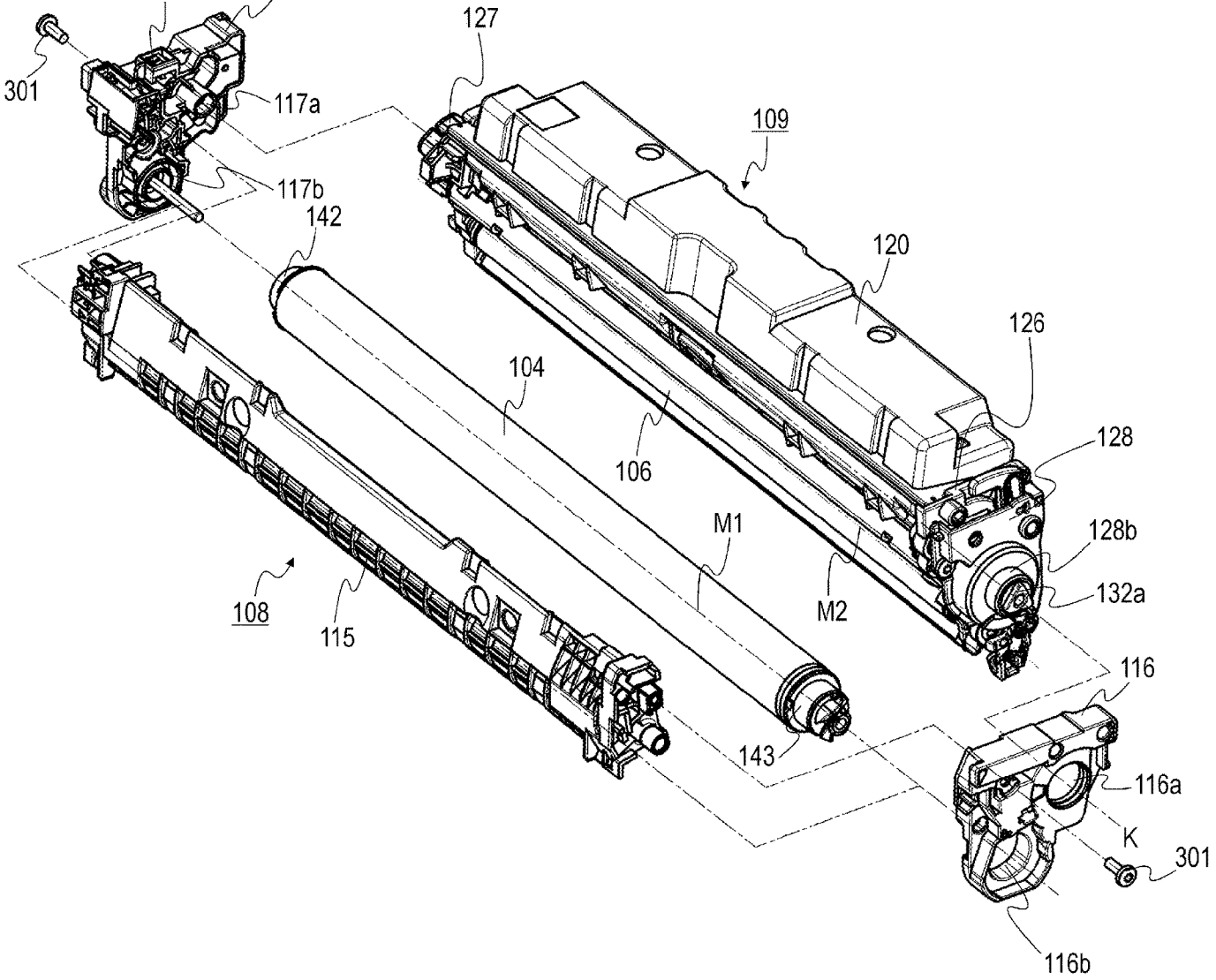
FIG. 12 is an assembly perspective view of the process cartridge.

A configuration of the process cartridge will be described with reference to FIGS. 2, 12, and 13. FIG. 12 is an exploded perspective view of the process cartridge 100 from the driving side, which is one end side in an axial direction of the photosensitive drum 104. FIG. 13 is a perspective view of the process cartridge 100 from the driving side.

In the present example, the first to fourth process cartridges 100 (100Y, 100M, 100C, and 100K) may differ in a color of stored toner, a filling amount of toner, and control performed by the apparatus main body 170. However, these four process cartridges have the same basic structure and functions to be fulfilled, although there may be differences in dimensions and the like. For this reason, one process cartridge 100 will be described as a representative below.

The process cartridge 100 includes the photosensitive drum (photosensitive member) 104, and process unit that act on the photosensitive drum 104. Here, as the process unit, there are the charging roller 105 serving as a charging portion (a charging member) for charging the photosensitive drum 104, the developing roller 106 serving as a developing portion (a developing member) for causing toner to adhere to the photosensitive drum 104 to develop a latent image formed on the photosensitive drum 104, and the like. The developing roller 106 carries toner on its surface. Also, as a further process unit, the process cartridge 100 may include a cleaning blade, a brush, or the like that abuts the photosensitive drum 104, which serves as a cleaning portion (a cleaning member) for removing residual toner on the surface of the photosensitive drum 104. Further, as a further process unit, it may include light guide members such as a light guide and a lens, a light source, and the like for irradiating the photosensitive drum 104 with light, which serves as a static eliminating portion for eliminating static electricity on the surface of the photosensitive drum 104. In addition, the process cartridge 100 is divided into the drum unit (a first unit) 108 (108Y, 108M, 108C, and 108K), and the developing unit (a second unit) 109 (109Y, 109M, 109C, and 109K).

Configuration of Drum Unit

As shown in FIGS. 2 and 12, the drum unit 108 includes the photosensitive drum 104, the charging roller 105, and a first drum frame body portion 115. In addition, the drum unit 108 has the driving side cartridge cover member 116 and the non-driving side cartridge cover member 117, which serve as a second drum frame body portion attached and fixed to the first drum frame body portion 115. The photosensitive drum 104 is rotatably supported around a rotation axis (a rotation center) M1 by the driving side cartridge cover member 116 and the non-driving side cartridge cover member 117 disposed at both ends in the longitudinal direction of the process cartridge 100. The first drum frame body portion 115, and the driving side cartridge cover member 116 and the non-driving side cartridge cover member 117 serving as the second drum frame body portion constitute a drum frame body (a first frame body or a photosensitive member frame body) that rotatably supports the photosensitive drum 104. The driving side cartridge cover member 116 and the non-driving side cartridge cover member 117 will be described later.

Figure 13:
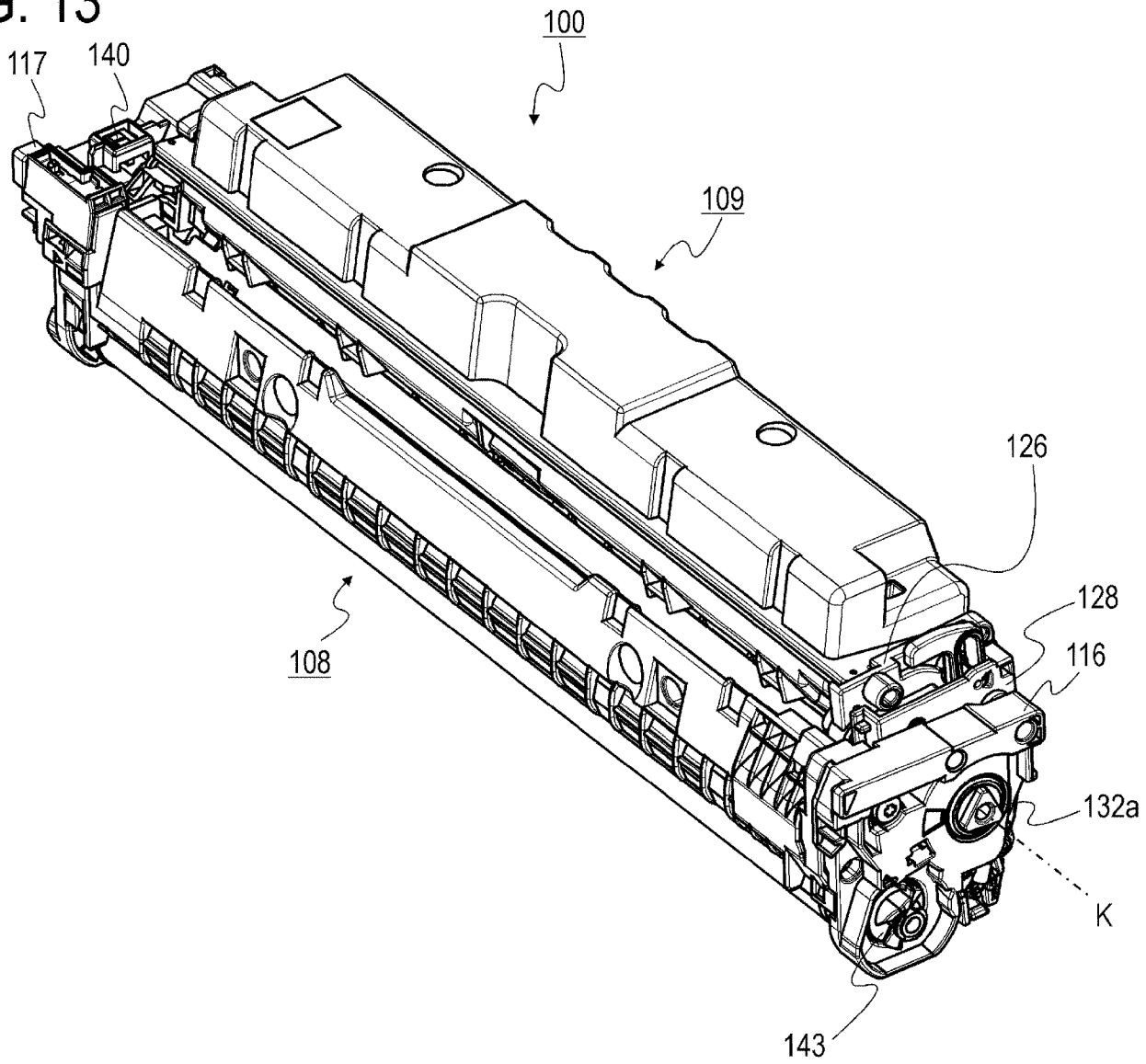
FIG. 13 is a perspective view of the process cartridge.

As shown in FIGS. 12 and 13, the drum coupling member 143 for transmitting a driving force to the photosensitive drum 104 is provided on one end side of the photosensitive drum 104 in the longitudinal direction. As described above, the drum coupling member 143 engages with the main body side drum drive coupling 180 (see FIGS. 8A and 8B) serving as a drum drive output portion of the apparatus main body 170. Then, a driving force of a drive motor (not shown) of the apparatus main body 170 is transmitted to the photosensitive drum 104, which is rotated in the direction of arrow A (see FIG. 2). Further, the photosensitive drum 104 has a drum flange 142 on the other end side in the longitudinal direction. The charging roller 105 is supported by the first drum frame body portion 115 so that it can come into contact with the photosensitive drum 104 and rotate in a driven manner. Also, the rotation axis M1 is parallel to the longitudinal direction of the process cartridge 100 and the longitudinal direction of the drum unit 108.

Configuration of Developing Unit

As shown in FIGS. 2 and 12, the developing unit 109 is configured of the developing roller 106, a toner conveying roller (a developer feed member) 107, a developing blade 130, a developer container 120, and the like. The developer container 120 that constitutes a frame body of the developing unit is configured of a developing frame body 121 and a lid member 122. The developing frame body 121 and the lid member 122 are joined by ultrasonic welding or the like. The developer container 120 has a toner storage portion (a toner storage chamber) 129 for storing toner fed to the developing roller 106, and a developing space 123 serving as a space for feeding toner to the developing roller 106 in which the toner conveying roller 107 is disposed. In the developer container 120, a driving side bearing 126 and a non-driving side bearing 127 serving as bearing members are attached and fixed to both ends in the longitudinal direction of the developing frame body 121 disposed in the longitudinal direction of the developing roller 106 with respect to the developing roller 106. In addition, the developer container 120 rotatably supports the developing roller 106, the toner conveying roller 107, and a stirring member 129*a* (see FIG. 2) via the driving side bearing 126 and the non-driving side bearing 127, and holds the developing blade 130. In this way, the developer container 120, the driving side bearing 126, and the non-driving side bearing 127 constitute a developing frame body (a second frame body) that rotatably supports the developing roller 106 around a rotation axis (a rotation center) M2.

The stirring member 129*a* rotates to stir the toner in the toner storage portion 129. The toner conveying roller (developer feed member) 107 comes into contact with the developing roller 106, feeds the toner to the surface of the developing roller 106, and also performs stripping of the toner from the surface of the developing roller 106. The developing blade 130 is formed by attaching an elastic member 130*b*, which is a sheet-like metal having a thickness of about 0.1 mm, to a support member 130*a*, which is a metal material having an L-shaped cross-section, by welding or the like. As a regulating member, the developing blade 130 regulates a layer thickness of the toner (a thickness of a toner layer) on a circumferential surface of the developing roller 106 and forms the toner layer having a predetermined thickness between the elastic member 130*b* and the developing roller 106. The developing blade 130 is attached to the developer container 120 with screws 118 at two locations on one end side and the other end side in the longitudinal direction. The developing roller 106 is configured of a core metal 106*c* made of a metal material and a rubber portion 106*d*.

Figure 14:
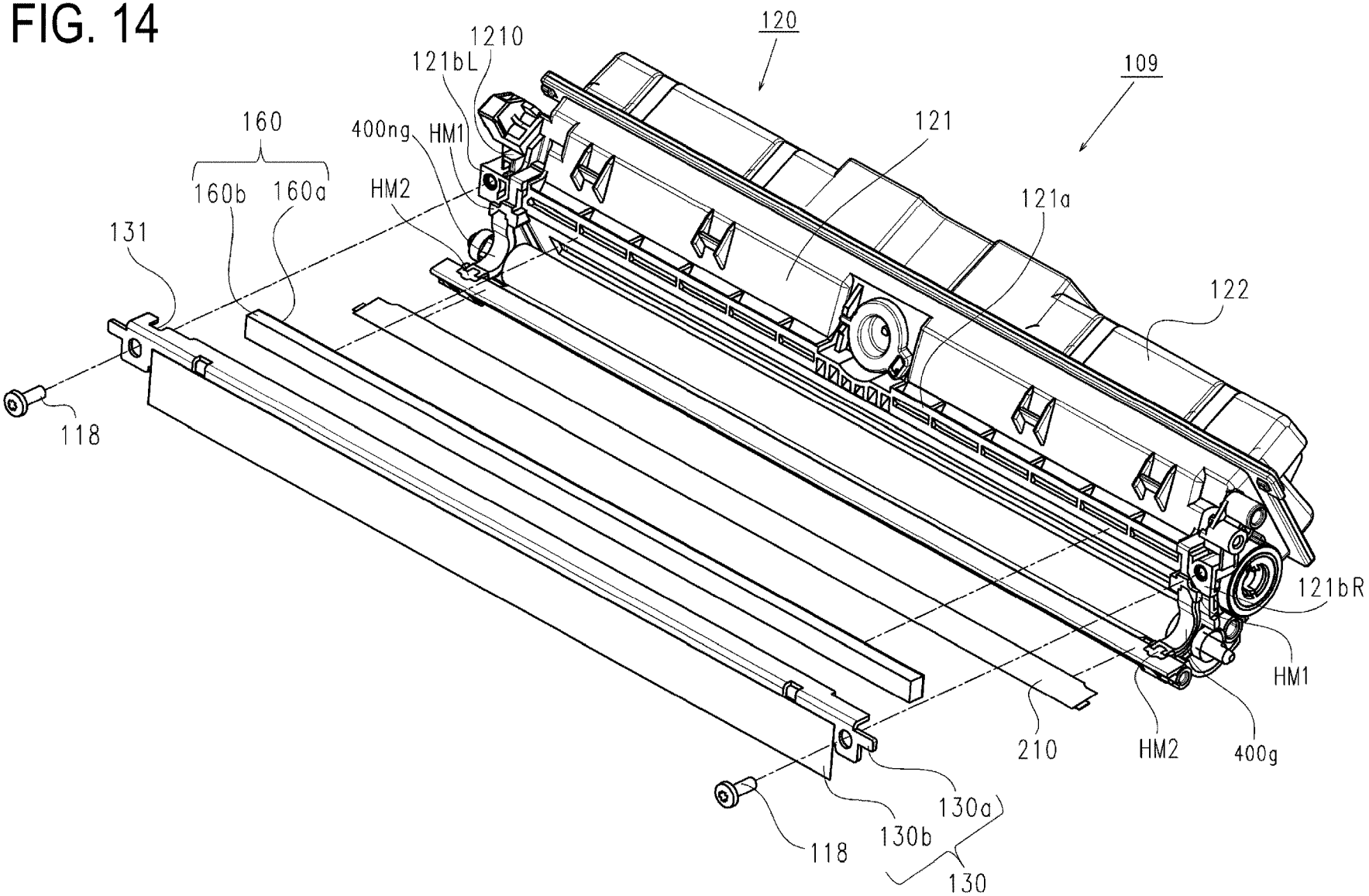
FIG. 14 is an assembled exploded view of a part of a developing unit.

As shown in FIGS. 12 and 14, the developing coupling portion 132*a* for transmitting a driving force to the developing unit 109 is provided on one end side of the developing unit 109 in the longitudinal direction. The developing coupling portion 132*a* is a member that engages with the main body side developing drive coupling 185 (see FIGS. 8A and 8B) serving as a developing drive output portion of the apparatus main body 170 and receives a rotational driving force of the drive motor (not shown) of the apparatus main body 170 to rotate. The driving force received by the developing coupling portion 132*a* is transmitted by a drive train (not shown) provided in the developing unit 109, so that the developing roller 106 can be rotated in a direction of arrow D in FIG. 2. A developing cover member 128 that supports and covers the developing coupling portion 132*a* and a drive train (not shown) is provided on one end side of the developing unit 109 in the longitudinal direction. Also, an outer diameter of the developing roller 106 is set to be smaller than an outer diameter of the photosensitive drum 104. The outer diameter of the photosensitive drum 104 of the present example is set in the range of Φ18 to Φ22, and the outer diameter of the developing roller 106 is set in the range of Φ8 to Φ14. By setting this outer diameter, it is possible to perform efficient arrangement. However, the outer diameters of the photosensitive drum 104 and the developing roller 106 are not limited to the above ranges. In addition, the rotation axis M2 is parallel to the longitudinal direction of the process cartridge 100 and the longitudinal direction of the developing unit 109.

Assembly of Drum Unit and Developing Unit

Assembly of the drum unit 108 and the developing unit 109 will be described with reference to FIG. 12. The drum unit 108 and the developing unit 109 are joined together by the driving side cartridge cover member 116 and the non-driving side cartridge cover member 117 provided at both ends of the process cartridge 100 in the longitudinal direction. The driving side cartridge cover member 116 is provided on one end side of the process cartridge 100 in the longitudinal direction. The driving side cartridge cover member 116 is provided with a developing unit support hole 116*a* for supporting the developing unit 109 to be swingable (movable). The non-driving side cartridge cover member 117 is provided on the other end side of the process cartridge 100 in the longitudinal direction. The non-driving side cartridge cover member 117 is provided with a developing unit support hole 117*a* for supporting the developing unit 109 to be swingable. Further, the driving side cartridge cover member 116 and the non-driving side cartridge cover member 117 are provided with drum support holes 116*b* and 117*b* for supporting the photosensitive drum 104 to be rotatable.

Here, an outer diameter portion of a cylindrical portion 128*b* of the developing cover member 128 is fitted into the developing unit support hole 116*a* of the driving side cartridge cover member 116 on one end side of the process cartridge 100 in the longitudinal direction. An outer diameter portion of a cylindrical portion (not shown) of the non-driving side bearing 127 is fitted into the developing unit support hole 117*a* of the non-driving side cartridge cover member 117 on the other end side of the process cartridge 100 in the longitudinal direction. Further, both ends of the photosensitive drum 104 in the longitudinal direction are fitted into the drum support hole 116*b* of the driving side cartridge cover member 116 and the drum support hole 117*b* of the non-driving side cartridge cover member 117. Then, the driving side cartridge cover member 116 and the non-driving side cartridge cover member 117 are fixed to the drum unit 108 by screws 118. Also, a fixing method may be adhesives or the like instead of screws. Thus, the developing unit 109 is movably supported by the driving side cartridge cover member 116 and the non-driving side cartridge cover member 117 with respect to the drum unit 108 (photosensitive drum 104). In such a configuration, the developing roller 106 can be positioned at a position that acts on the photosensitive drum 104 during image formation.

FIG. 13 shows a state in which the drum unit 108 and the developing unit 109 are assembled by the above steps and integrated as the process cartridge 100. Also, an axis connecting a center of the developing unit support hole 116*a* of the driving side cartridge cover member 116 and a center of the developing unit support hole 117*a* of the non-driving side cartridge cover member 117 is referred to as a swing axis (a rotation axis or a rotation center) K (see FIGS. 12 and 13). Here, the cylindrical portion 128*b* of the developing cover member 128 on one end side of the process cartridge 100 in the longitudinal direction is coaxial with the developing coupling portion 132*a*. That is, the rotation axis of the developing coupling portion 132*a* is coaxial with the swing axis K. In addition, the developing unit 109 is rotatably supported around the swing axis K. In a state in which the drum unit 108 and the developing unit 109 are assembled and integrated as the process cartridge 100, the rotation axis M1, the rotation axis M2, and the swing axis K are substantially parallel to each other. Further, in this state, the rotation axis M1, the rotation axis M2, and the swing axis K are substantially parallel to the longitudinal direction of the process cartridge 100 as well.

Configuration of Toner Seal of Developing Unit

Figure 15:
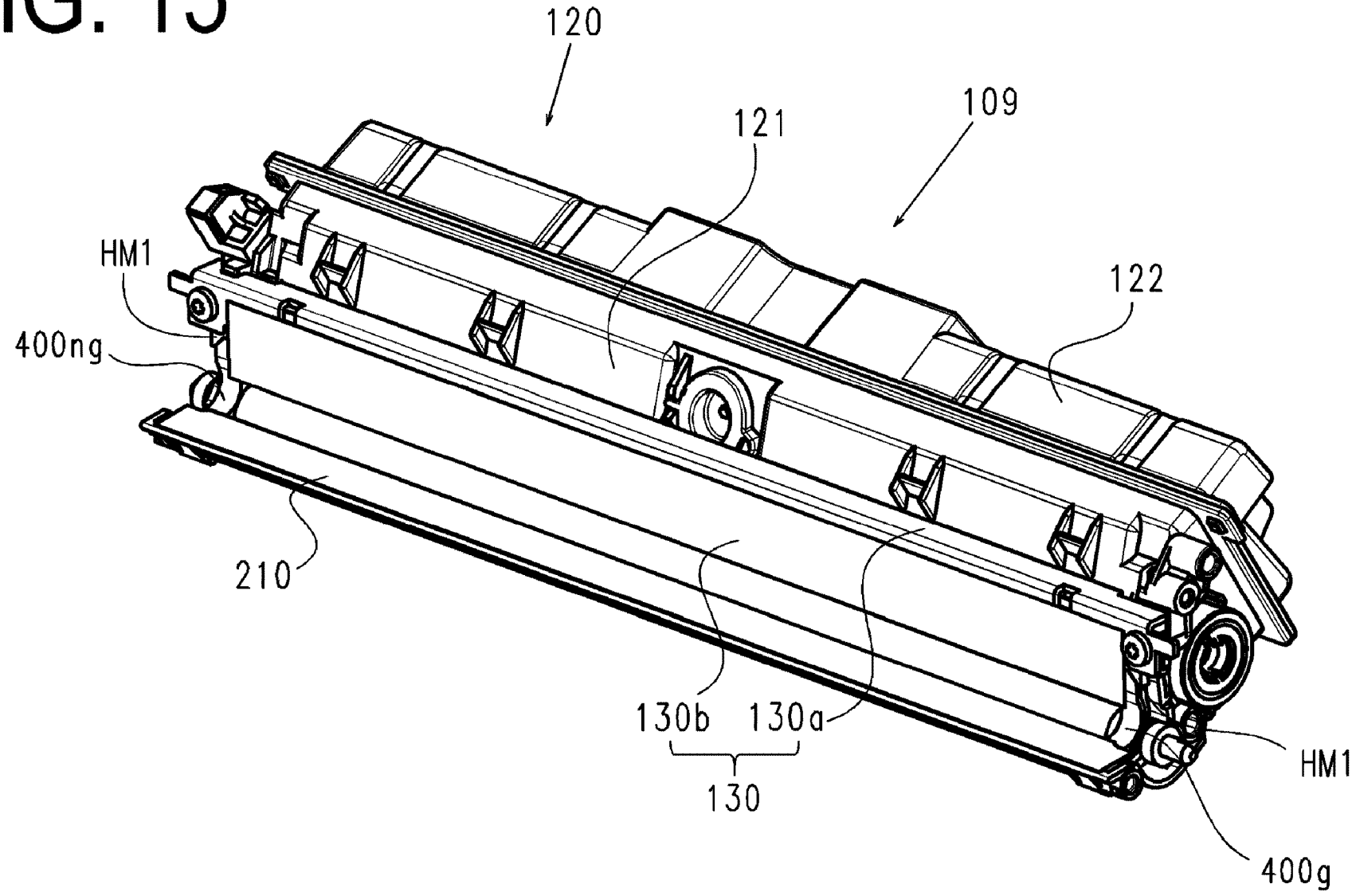
FIG. 15 is an assembly perspective view of a part of the developing unit.
Figure 16:
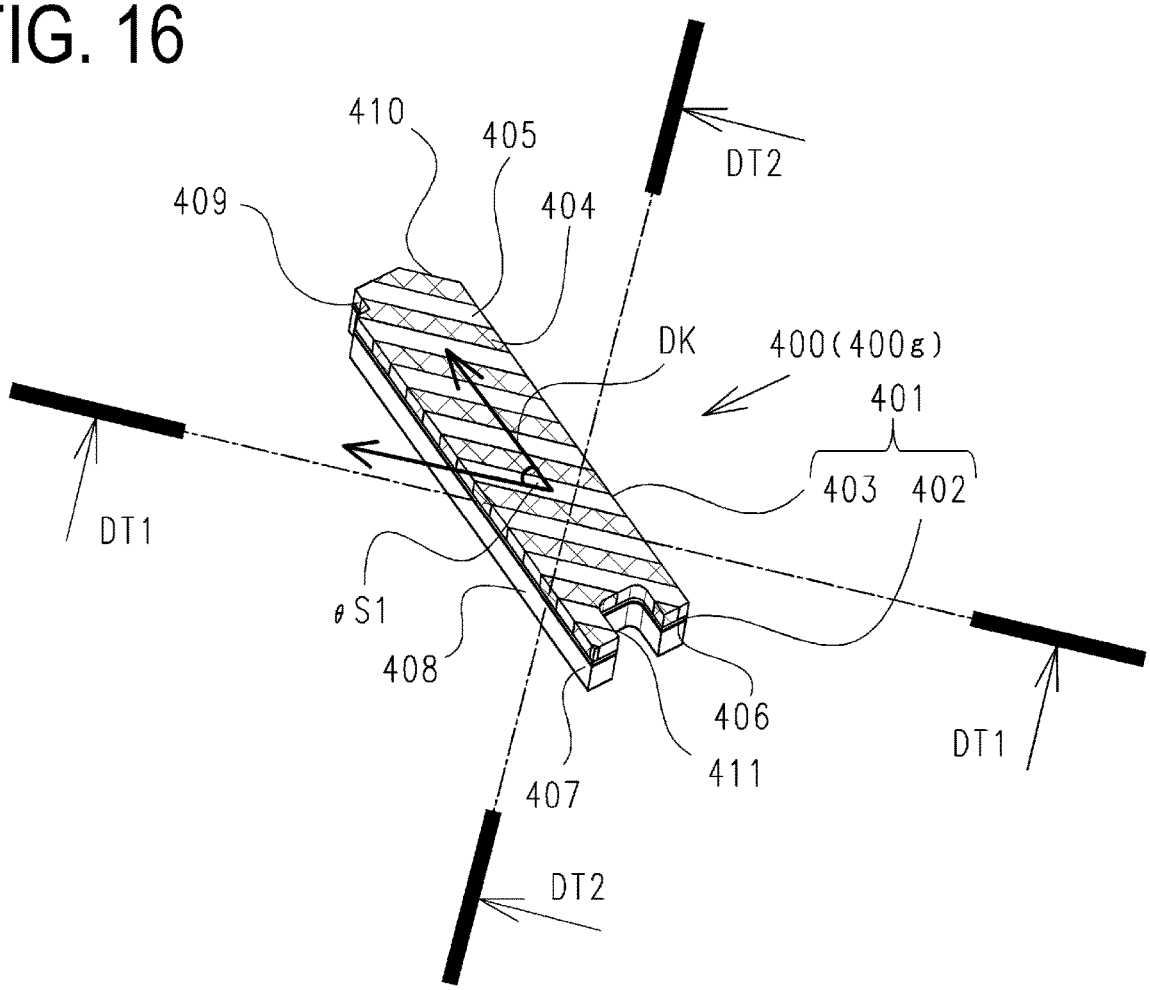
FIG. 16 is a perspective view of an end seal.
Figure 17:
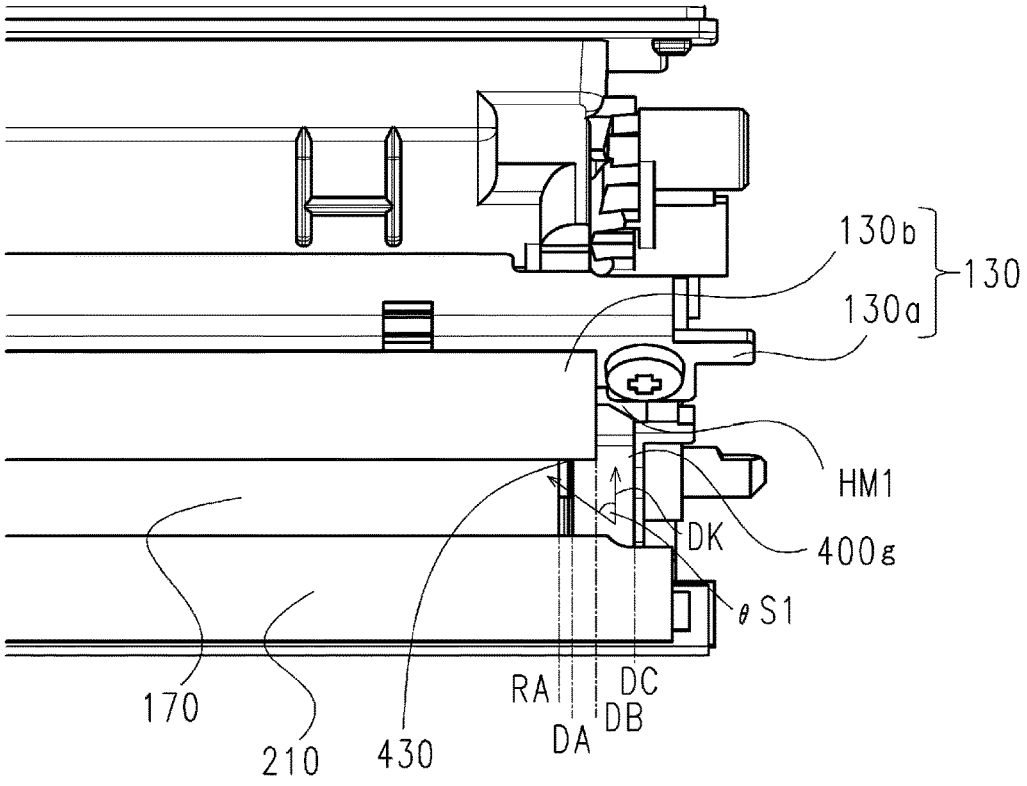
FIG. 17 is an assembled enlarged view of a part of the developing unit.
Figure 18:
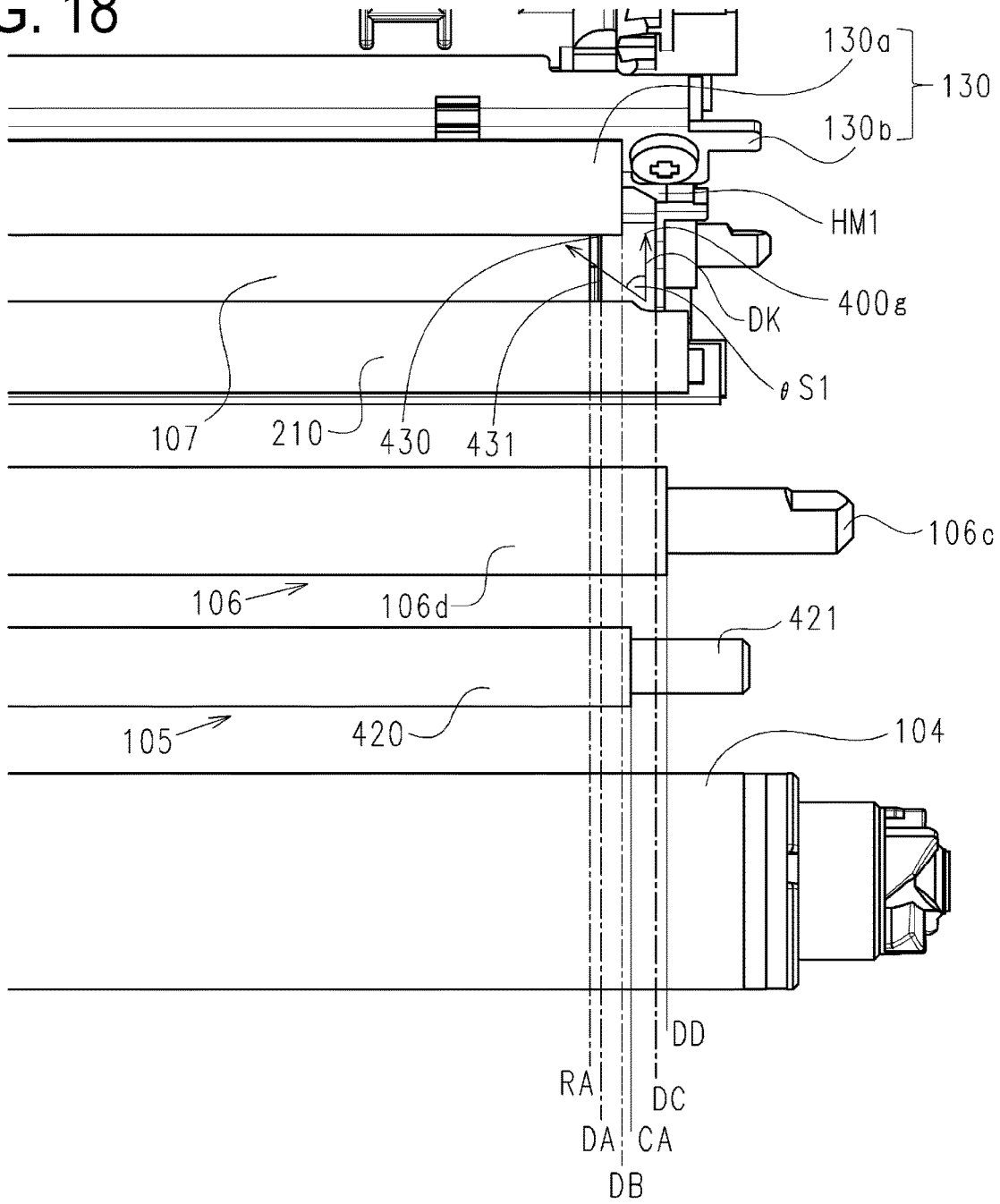
FIG. 18 is an explanatory view of a longitudinal width of the end seal.
Figure 19B:
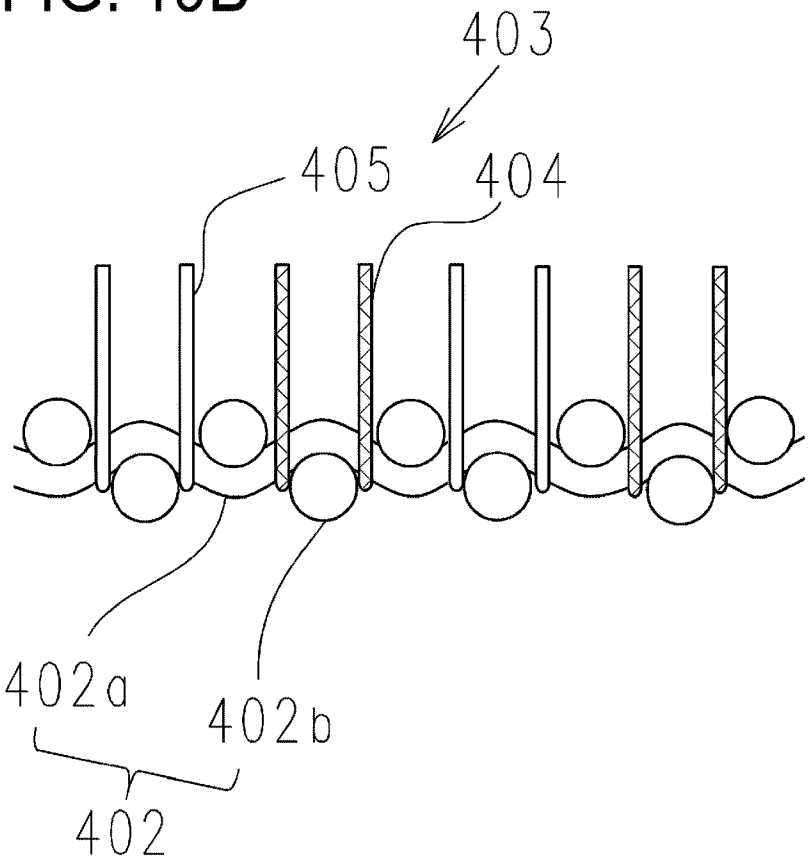
FIGS. 19A and 19B are enlarged views of a surface layer of the end seal.
Figure 19A:
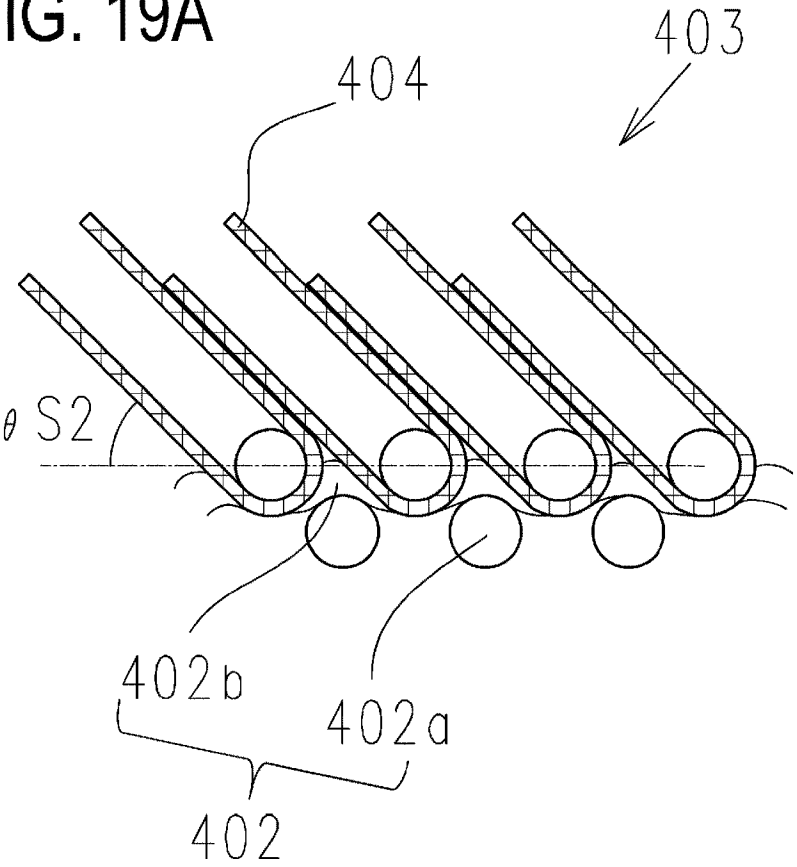
Figure 20:
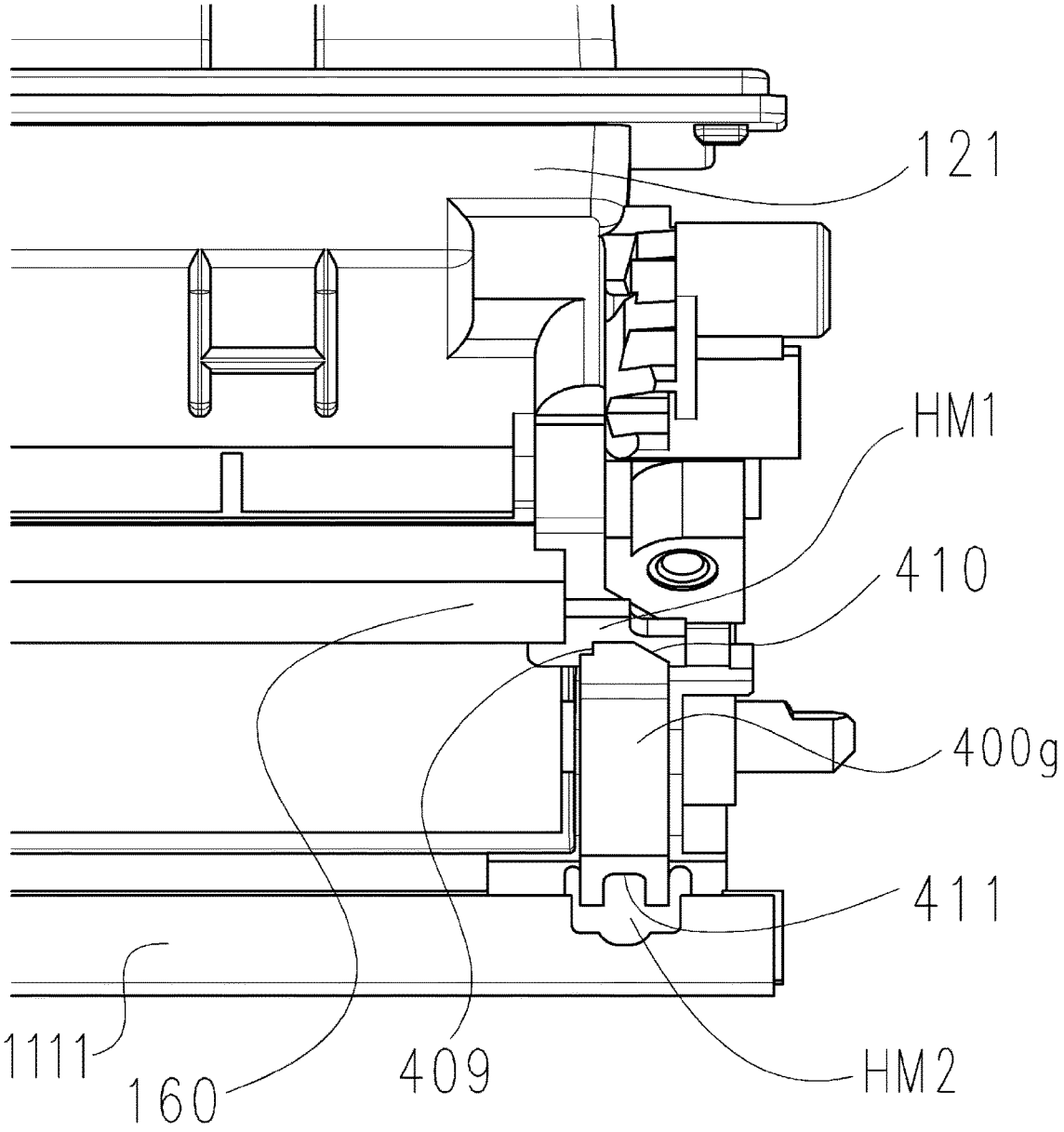
FIG. 20 is a schematic front view of a vicinity of a driving side end portion of the developing unit.
Figure 21:
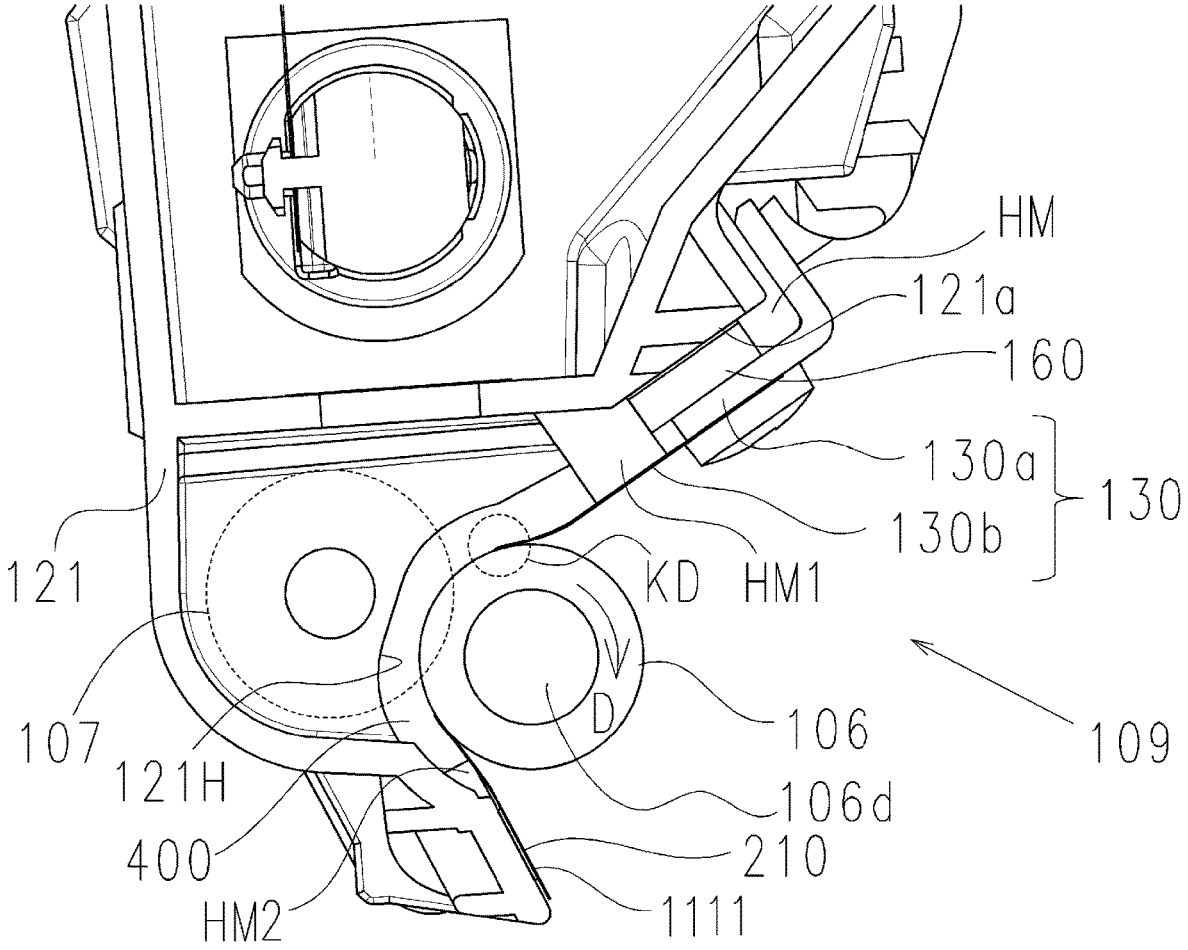
FIG. 21 is a partially enlarged cross-sectional view of the developing unit.
Figure 22:
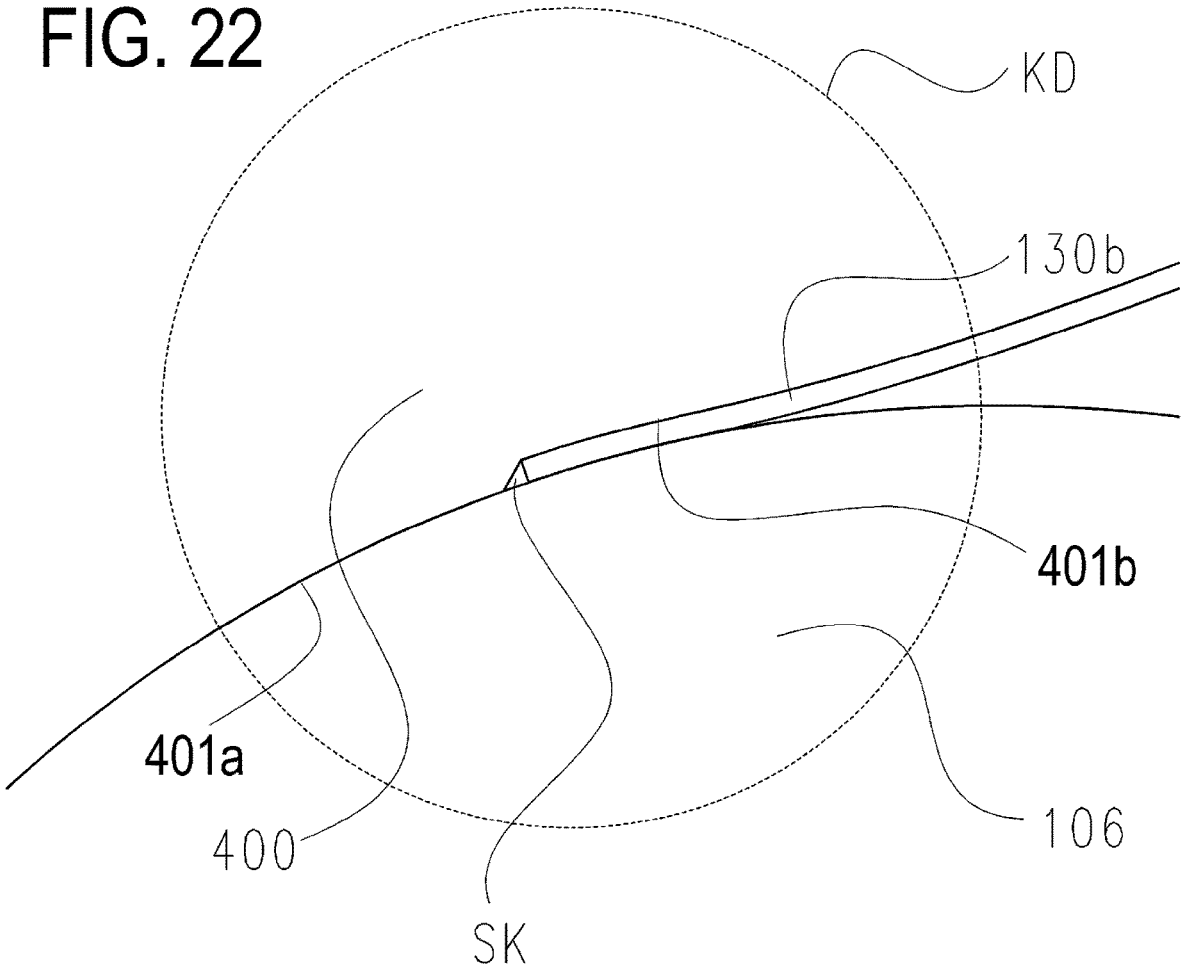
FIG. 22 is an enlarged cross-sectional view of a vicinity of a tip of an elastic member of a developing blade.
Figure 23:
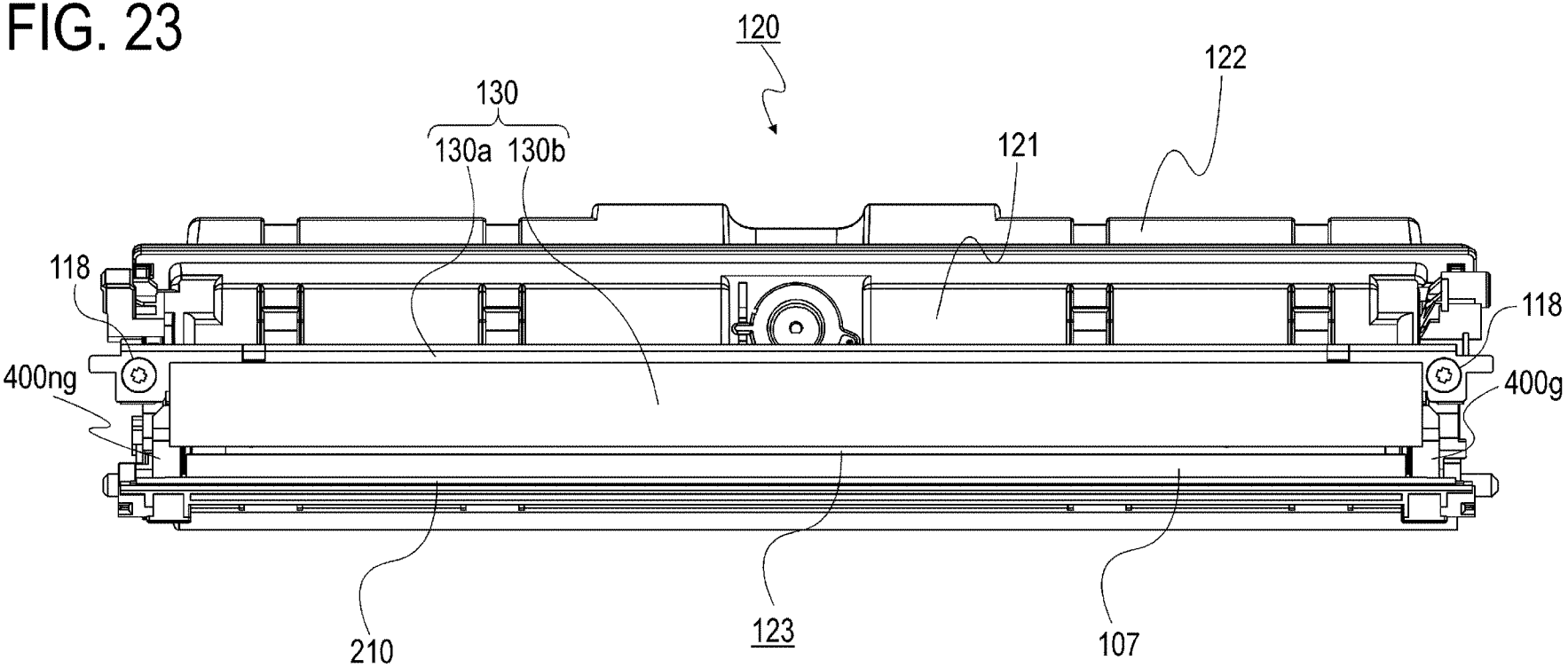
FIG. 23 is a front view of the developing unit.
Figure 24:
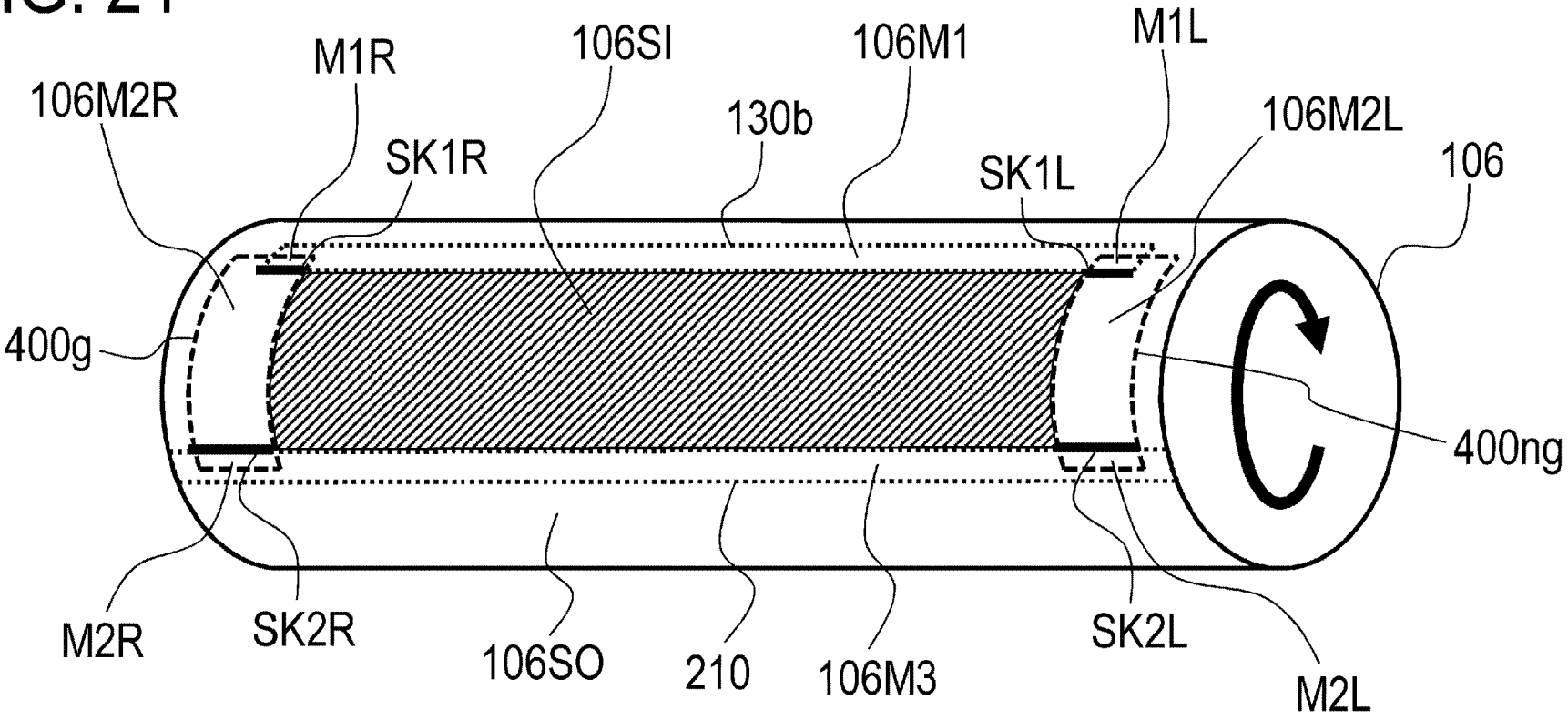
FIG. 24 is a schematic perspective view of a developing roller.

A configuration of a toner seal of the developing unit 109 will be described with reference to FIGS. 14 to 24. FIG. 14 is an assembly perspective view (a disassembled perspective view) of the developing blade 130, an under-blade seal 160, and a sheet member 210 from the driving side when assembled to the developer container 120. FIG. 15 is an assembly perspective view of the developing unit 109 from the driving side after the developing blade 130, the under-blade seal 160, and the sheet member 210 are assembled to the developer container 120 (before the developing roller 106 is assembled). FIG. 16 is a perspective view of a driving side end seal 400*g*. FIG. 17 is a schematic enlarged front view showing the driving side of the developing unit 109 in FIG. 15 (the perspective view after assembly). FIG. 18 is a schematic view for describing a longitudinal width of an end seal 400 and is an exploded view showing a positional relationship with constituent members assembled to the process cartridge in the longitudinal direction. FIGS. 19A and 19B are schematic enlarged views of a surface layer 401 of the end seal 400. FIG. 20 is a schematic front view of a vicinity of a driving side end of the developing unit 109, which is a diagram excluding the developing blade 130 and the sheet member 210 for showing a configuration of a sealing portion HM (HM1 and HM2). FIG. 21 is a schematic cross-sectional view of the developing unit 109, which is a partial enlarged cross-sectional view showing a structure around the end seal 400. FIG. 22 is a schematic enlarged cross-sectional view showing a KD portion in FIG. 21 and is a diagram showing a minute gap SK formed between the elastic member 130*b*, the end seal 400, and the developing roller 106 at a tip of the elastic member 130*b* of the developing blade 130. FIG. 23 is a front view of the developing unit 109 in an assembling direction of the developing blade 130 after the developing blade 130, the under-blade seal 160, and the sheet member 210 are assembled to the developer container 120 (before the developing roller 106 is assembled). FIG. 24 is a schematic perspective view for describing a region of the outer circumferential surface of the developing roller 106 defined by the developing blade 130, the sheet member 210, and end seals 400.

As shown in FIGS. 14 and 15, as a configuration of a toner seal for sealing the toner in the developer container 120, the end seals 400, the under-blade seal 160, and the sheet member 210 are disposed in the developing frame body 121. The end seals 400 are provided at both ends of the developing frame body 121 in the longitudinal direction (the driving side end seal 400*g* and a non-driving side end seal 400*ng*).

The developer container 120 (developing frame body 121) has a substantially rectangular opening portion that communicates the developing space 123 with the outside, and the developing roller 106 is disposed to close the opening portion. As shown in FIG. 23, the developing blade 130 (the under-blade seal 160), the end seals 400, and the sheet member 210 are provided along a substantially rectangular edge of the opening portion in a continuous arrangement to surround the opening portion in an annular shape. By assembling the developing roller 106 to the developing frame body 121 to be in pressure contact with the plurality of members, a plurality of regions are defined on the outer circumferential surface of the developing roller 106. This state is shown in FIG. 24.

That is, as shown in FIG. 24, on an outer circumferential surface 106S of the developing roller 106, a region 106SI exposed to (facing) the developing space 123 of the developer container 120 and a region 106SO exposed to the outside of the developer container 120 are defined. On the outer circumferential surface 106S of the developing roller 106, a seal region 106M1 with which the developing blade 130 (elastic member 130*b*) comes into contact, seal regions 106M2R and 106M2L with which the end seals 400 come into contact, and a seal region 106M3 with which the sheet member 210 comes into contact are defined. The region 106SI surrounded by the seal regions 106M1 to M3 is a region exposed to the developing space 123 on the outer circumferential surface 106S of the developing roller 106. The developing blade 130 (elastic member 130*b*), the end seals 400, and the sheet member 210 are in close contact with the outer circumferential surface 106S of the developing roller 106 to surround the region 106SI. The region 106SO outside the seal regions 106M1 to M3 on the outer circumferential surface 106S of the developing roller 106 becomes a region of the developing roller 106 exposed to the outside of the developer container 120.

The developing blade 130 and the sheet member 210 are disposed respectively on two long sides parallel to the longitudinal direction of the developer container 120 among four sides constituting the rectangular edge of the opening portion of the developer container 120 in which the developing roller 106 is disposed. The developing blade 130 is disposed on a downstream side of the two long sides in a rotating direction of the developing roller 106, and the sheet member 210 is disposed on an upstream side thereof. The developing blade 130 has the support member 130*a* serving as a support portion, and the elastic member 130*b* serving as a sliding portion. The support member 130*a* is disposed to extend in the longitudinal direction of the developer container 120, and both end portions thereof are fixed to the developing frame body 121 by screws 118. The under-blade seal 160 is interposed between a region between both end portions of the support member 130*a* fixed by the screws 118 and the developing frame body 121, and a gap between the support member 130*a* and the developing frame body 121 is sealed. That is, the under-blade seal 160 is disposed, as a longitudinal seal member, in the longitudinal direction of the developer container 120 on a side of the opening portion of the developer container 120 parallel to the longitudinal direction. A downstream end portion of the elastic member 130*b* in the rotating direction of the developing roller 106 is fixed to the support member 130*a*, and an upstream end portion thereof is disposed to be in sliding contact with the circumferential surface of the developing roller 106 in the longitudinal direction.

Further, the end seals 400 are disposed in a symmetric configuration in the longitudinal direction on the remaining two short sides parallel to each other in the rotating direction of the developing roller 106 among the four sides constituting the rectangular edge which is a portion of the developer container 120 outside the opening portion. The end seals 400 are attached to end seal attachment surfaces (end seal seating surfaces that are curved in depressed shapes) 121H provided on the two short sides of the developer container 120 (see FIG. 21). The end seals 400 provided in pairs are provided to extend along the rotating direction of the developing roller 106 to connect respective longitudinal ends of the developing blade 130 and the sheet member 210 to each other. The end seals 400 serving as the end seal members come into contact with and slide on both end portions of the developer container 120 in the longitudinal direction (the direction of the rotation axis of the developing roller 106) on the outer circumferential surface of the developing roller 106.

As shown in FIGS. 14, 15, and 21, the end seals 400 are curved to closely abut the circumferential surface of the developing roller 106 and disposed in the developing frame body 121. While the developing roller 106 is being driven, a surface layer 401 (a layer having a sliding surface that is curved in a depressed shape to conform to an outer circumferential shape of the developing roller 106) of the end seals 400 in contact with the developing roller 106 is in a state of being rubbed. Further, there is a container adhesive layer 408 (a layer having an adhesive surface that is curved in a depressed shape to conform to the end seal attachment surface 121H of the developing frame body 121 that is curved in a depressed shape) on the developing frame body 121 side of the end seal 400, which is adhesively fixed to the developing frame body 121. Details of a material of the end seal 400 will be described later.

As shown in FIG. 16, the end seal 400 is configured of the surface layer 401, an intermediate adhesive layer 406, an intermediate layer 407, and the container adhesive layer (a frame body adhesive layer) 408. Details thereof will be described later. Also, although FIG. 16 shows a configuration of the driving side end seal 400*g*, the non-driving side end seal 400*ng* has a configuration symmetrical with respect to the driving side end seal 400*g* in the longitudinal direction of the developing frame body 121 (the direction of the rotation axis of the developing roller 106).

As shown in FIG. 21, on a rubbing surface side of the end seal 400 with the developing roller 106, the flexible sheet member 210 is disposed on an upstream side of a rotating direction DK of the developing roller 106 (a sliding direction of the developing roller 106 with respect to the surface layer 401 of the end seal 400). Also, the elastic member 130*b* of the developing blade 130 is disposed on a downstream side of the developing roller 106 in the rotating direction DK.

Here, as shown in FIG. 21, tip sides of the sheet member 210 are partially sandwiched between the end seals 400 and the developing roller 106. Regions in which the sheet member 210, the end seals 400, and the developing roller 106 overlap each other are indicated by reference numerals M2R and M2L in FIG. 24. That is, vicinities of both longitudinal ends of the tip of the sheet member 210 are boundary regions in which abutment regions between the sheet member 210 and the end seals 400, abutment regions between the end seals 400 and the developing roller 106, and an abutment region between the developing roller 106 and the sheet member 210 are present in close proximity to each other.

Similarly, as shown in FIG. 21, tip sides of the elastic member 130*b* of the developing blade 130 are partially sandwiched between the end seals 400 and the developing roller 106. The regions in which the elastic member 130*b*, the end seals 400, and the developing roller 106 overlap each other are indicated by reference numerals M1R and M1L in FIG. 24. That is, vicinities of both longitudinal ends of the tip of the elastic member 130*b* are boundary regions in which abutment regions between the elastic member 130*b* and the end seals 400, abutment regions between the end seals 400 and the developing roller 106, and an abutment region between the developing roller 106 and the elastic member 130*b* are present in close proximity to each other. FIG. 22 shows an enlarged axial configuration of a configuration around the tip of the elastic member 130*b*. As shown in FIG. 22, the surface layers 401, which are seal surfaces of the end seals 400, each have a sliding seal region (a sliding seal surface) 401*a* that comes into sliding contact with the developing roller 106, and a non-sliding seal region (a non-sliding seal surface or a sandwiching seal surface) 401*b* that sandwiches the tip of the elastic member 130*b* together with the outer circumferential surface of the developing roller 106. As shown in FIG. 24, the sliding seal regions 401*a* are regions that come into sliding contact with the seal regions 106M2R and 106M2L on the outer circumferential surface of the developing roller 106. Further, as shown in FIG. 24, the non-sliding seal regions 401*b* are regions in close contact with the elastic member 130*b* in the regions M1R and M1L.

With the above configuration, the gaps at the end portions of the developer container 120 in the longitudinal direction are filled, and the toner seal of the end seals 400 is performed. Details of the configuration for the toner seal of the end seals 400 will be described later.

As shown in FIG. 14, the under-blade seal 160 is configured of a double-sided tape 160*a* and an elastic foam member 160*b* and is attached to an under-blade seal attachment surface 121*a* of the developing frame body 121 by the double-sided tape 160*a*. After that, as shown in FIG. 21, the under-blade seal 160 is configured to fill a gap between the support member 130*a* and the developing frame body 121 when the developing blade 130 is assembled to the developing frame body 121.

The developing blade 130 is configured of the support member 130*a* and the elastic member 130*b*. The elastic member 130*b* is made of a stainless steel plate or a thin plate of phosphor bronze having a thickness of about 0.1 mm. The support member 130*a* is made of a steel plate having a thickness of 1 to 2 mm. The support member 130*a* and the elastic member 130*b* are positioned by a positioning mechanism (not shown) and are joined together by spot welding or the like using a laser. In addition, the support member 130*a* is provided with a first notch portion 131 for positioning the developing blade 130 on the developing frame body 121. The first notch portion 131 is fitted to a support member positioning portion 1210 of the developing frame body 121 to determine a longitudinal position of the developing blade 130 in the process cartridge 100. Further, the developing blade 130 is fixed to the developing frame body 121 by tightening the screws 118 while longitudinal ends of the support member 130*a* come into contact with blade attachment surfaces 121*b* (121bR and 121bL) of the developing frame body 121. A side of the elastic member 130*b* in a lateral direction thereof (a direction orthogonal to the longitudinal direction) opposite to a side joined to the support member 130*a* becomes a free end, and a part of the free end comes into contact with the circumferential surface of the developing roller 106, and thus an amount of the toner held by the developing roller 106 is regulated.

Here, as shown in FIGS. 14 and 21, a hot melt resin is injected into minute gaps formed when the end seals 400, the developing blade 130, and the under-blade seal 160 are attached to the developing frame body 121 to form the sealing portions HM1. Thus, it is configured to ensure adhesion of the end seals 400, the developing blade 130, and the under-blade seal 160 to the developing frame body 121. Specifically, as shown in FIGS. 16 and 20, the driving side end seal 400*g* is provided with notch portions 409 and 410 for hot melt adhesion. By injecting the hot melt resin into the notch portions 409 and 410 for hot melt adhesion to form the sealing portions HM1, it is possible to tightly seal the minute gaps formed when the driving side end seal 400*g*, the developing blade 130, and the under-blade seal 160 are attached to the developing frame body 121. As shown in FIG. 15, the sealing portions HM1 are formed by injecting and filling the hot melt resin from a predetermined injection port after the driving side end seal 400*g*, the developing blade 130, and the under-blade seal 160 are assembled to the developing frame body 121 (before the developing roller 106 is assembled). The hot melt resin for forming the sealing portions HM in the present example is composed of a mixture of a thermoplastic rubber, a tackifier resin, and the like and has a property that it is liquefied by heating and hardened into an elastic solid by cooling.

The sheet member 210 is a flexible resin sheet made of a resin such as PPS having a thickness of about 0.1 mm and is attached and fixed to the developing frame body 121 by a double-sided tape 1111 attached to the developing frame body 121, as shown in FIG. 21. The sheet member 210 is disposed on the downstream side in the rotating direction of the developing roller 106 with respect to the developing blade 130 and over the entire longitudinal direction of the developing frame body 121. The sheet member 210 extends from a fixed portion fixed to the developing frame body 121 in the lateral direction to conform to the rotating direction of the developing roller 106, and the tip thereof becomes a free end.

As shown in FIG. 24, the sheet member 210 is configured such that a part of the free end side thereof abuts the circumferential surface of the developing roller 106 over the entire longitudinal direction. Further, the sheet member 210 has portions (M2L portion) that overlap the end seals 400 at both end portions in the longitudinal direction to come into contact with lateral end portions of the surface layers 401 of the end seals 400 (end portions of the surface layers 401 on the downstream side in the rotating direction of the developing roller 106).

Here, as shown in FIGS. 14 and 21, a hot melt resin is injected into minute gaps formed when the end seals 400 and the sheet member 210 are attached to the developing frame body 121 to form the sealing portions HM2. Thus, it is configured to ensure adhesion of the end seals 400 and the sheet member 210 to the developing frame body 121. Specifically, as shown in FIGS. 16 and 20, the driving side end seal 400*g* is provided with a notch portion 411 for hot melt adhesion. By injecting the hot melt resin into the notch portion 411 for hot melt adhesion to form the sealing portion HM2, it is possible to tightly seal the minute gap formed when the driving side end seal 400*g* and the sheet member 210 are attached to the developing frame body 121. As shown in FIG. 15, the sealing portion HM2 is formed by injecting and filling the hot melt resin from a predetermined injection port after the driving side end seal 400*g* and the sheet member 210 are assembled to the developing frame body 121 (before the developing roller 106 is assembled). A material of the hot melt resin for forming the sealing portion HM2 is the same as that of the sealing portion HM1 on the developing blade 130 side.

Configuration of End Seal of Developing Unit

FIG. 16 is a perspective view of the driving side end seal 400*g*. Since the non-driving side end seal 400*ng* has the same configuration, only the driving side end seal 400*g* will be described. The driving side end seal 400*g* is configured of the surface layer 401, the intermediate adhesive layer 406, the intermediate layer 407, and the container adhesive layer 408.

FIG. 19A is a cross-sectional view along DT1 in FIG. 16 and is an enlarged view of the surface layer 401 of the end seal 400. FIG. 19B is a cross-sectional view along DT2 in FIG. 16 and is an enlarged view of the surface layer 401 of the end seal 400. As shown in FIGS. 19A and 19B, the surface layer 401 is configured of a base fabric portion 402 formed by weaving warp threads 402*a* and warp threads 402*b*, and a pile fiber portion 403 serving as a fiber thread portion woven by pile weaving to stand on the base fabric portion 402. The fiber thread portion woven by pile weaving to stand is hereinafter referred to as a pile fiber portion.

The pile fiber portion 403 is rubbed with the developing roller 106 due to rotation of the developing roller 106 when it abuts the developing roller 106. The pile fiber portion 403 is configured of a plurality of types of fiber threads of different materials and is a pile woven fabric in which different fiber threads are disposed in stripes when a surface layer thereof is viewed from a side facing the developing roller. In the present example, the pile fiber portion 403 is configured of fiber threads 404 having the same charge property as the toner polarity (hereinafter referred to as first fiber threads 404), and fiber threads 405 having a charge property opposite to the toner polarity (hereinafter referred to as second fiber threads 405). In addition, the first fiber threads 404 and the second fiber threads 405 are disposed in stripe shapes at regular intervals in a longitudinal direction of the seal, that is, in the rotating direction DK of the developing roller 106. Toner charging polarities of the respective fiber threads 404 and 405 will be described later.

In the present example, as a configuration of a fiber bundle in the present invention, a plurality of fibers are twisted and formed into thread shapes to form the fiber threads 404 serving as a first fiber bundle and the fiber threads 405 serving as a second fiber bundle, but they are not limited to such a configuration. For example, the plurality of fibers constituting the fiber threads 404 and 405 may have a bundle-like configuration in which they are not twisted with each other. Accordingly, for example, it may be an untwisted bundle in which a plurality of fibers initially twisted in a thread shape are untwisted.

Further, as shown in FIGS. 19A and 19B, in the present example, the fiber threads 404 and 405 are preheated to tilt by an angle θS2 so that they are in a state of being tilted in advance in a direction in which each stripe extends with respect to a thickness direction (in a direction in which the layers overlap each other) of the end seal 400. The fiber threads 404 and 405 are caused to stand upright with respect to the base fabric portion 402 such that their tip sides are tilted with respect to their base sides, which are woven between the warp threads 402*a* and weft threads 402*b* of the base fabric portion 402, in the direction in which the stripe extends (a direction coming closer to an inner side of the developer container 120). Here, when a state of not tilting (a state of standing in the thickness direction of the end seal 400) is set to 0°, they are set to tilt by 10° to 90°. Thus, it is possible to achieve stable abutment with the developing roller 106 while rotational resistance (sliding resistance) thereagainst is inhibited. Also, the tilting may not be performed.

As shown in FIGS. 16, 19A, and 19B, the first fiber threads 404 and the second fiber threads 405 are disposed in stripe shapes in the longitudinal direction of the seal, that is, in the rotating direction DK of the developing roller 106. That is, the seal surface (surface layer 401) of the end seal 400 that is in sliding contact with the developing roller 106 is configured such that a strip-shaped first seal region configured of only a plurality of first fiber threads 404 and a strip-shaped second seal region configured of only a plurality of second fiber threads 405 are alternately disposed in a striped pattern. Each striped seal region extends in a direction inclined at an acute angle with respect to the rotating direction DK of the developing roller 106. More specifically, they are inclined with respect to a direction parallel to the rotation axis of the developing roller 106 and a direction around the rotation axis and extend in an inclined direction such that a portion thereof closer to the opening portion of the developer container 120 in the rotation axis direction is located further downstream in the rotating direction of the developing roller 106. Thus, when the developing roller 106 rotates, it alternately rubs against the first fiber threads 404 and the second fiber threads 405.

Further, as shown in FIG. 16, when the surface of the end seal 400 is viewed in a plan view, each of the fiber threads 404 and 405 in the pile fiber portion 403 is configured to be in a state of being inclined toward the inner side of the developer container 120 by an angle OS1 with respect to the rotating direction DK of the developing roller 106. The reason why is that they are disposed at angles so that the toner can be easily returned to the inside of the developer container 120 by a rotational frictional force of the developing roller 106 in a case in which the toner inside the developer container 120 partially penetrates into the surface layer 401 or the toner carried on the developing roller 106 adheres to a surface of the surface layer 401. In use of the end seal 400, the surface layer 401, which is the seal surface, forms a curved surface that is curved in a depressed shape with the rotation axis of the developing roller 106 as an axis of a center of curvature thereof. The striped (strip-shaped) seal region formed by each of the fiber threads 404 and 405 extends in a direction inclined with respect to a direction parallel to the axis and a direction around the axis.

As shown in FIG. 16, when a case in which the angle θS1 formed from the rotating direction DK of the developing roller 106 toward a direction inward in the longitudinal direction of the developer container is θS1=45° is set to a center, the angle is set with a tolerance in the range of 30° to 60°. Also, the angle exemplified here is merely an example and is appropriately set in consideration of toner sealing performance, production costs, and the like.

As described above, the toner carried on the developing roller 106 may also adhere to the pile fiber portion 403. For this reason, the pile fiber portion 403 is required to have a performance of wiping off the toner adhering to the developing roller 106 and a performance of collecting the toner inside the fiber portion. Further, the pile fiber portion 403 is required to have sliding performance with respect to the toner and the developing roller 106 for improving toner fluidity in order to return the toner to an internal direction of the developer container 120, and heat dissipation performance for preventing fusion of the toner due to frictional heat, and the like. Furthermore, by using a plurality of different types of pile fiber threads and selecting fiber threads having different toner charging polarities, it is possible to improve the sealing performance for preventing toner leakage. The relationship between the toner charge polarity of the fiber threads and the sealing performance will be described later.

Also, lengths of the fiber threads 404 and 405 used for the pile fiber portion 403 are set such that the developing roller 106 and the base fabric portion 402 do not come into contact with each other when the surface layer 401 abuts the developing roller 106. Here, since performances of the pile fiber portion 403 and the base fabric portion 402 are used separately, the developing roller 106 is prevented from coming into contact with the base fabric portion 402. When the standing pile fiber portion 403 abuts the developing roller 106, it abuts to fall and overlap the developing roller 106, and thus the developing roller 106 and the base fabric portion 402 do not abut each other. The base fabric portion 402 is required to have a fiber diameter for performing weaving at a density at which the toner is less likely to enter the vicinity of the base side of the pile fiber portion 403. Further, the base fabric portion 402 is also required to have durability, flexibility, heat resistance, and the like to prevent the pile fiber portion 403 from coming off due to the sliding resistance between the pile fiber portion 403 and the developing roller 106. Since the base fabric portion 402 does not abut the developing roller 106, it is possible to use, for example, inexpensive fiber threads having no sliding performance in order to reduce the cost.

Further, it is preferable that at least some of the fiber threads 404 and 405 constituting the pile fiber portion 403 be a material having a charge polarity that repels the normal charge polarity of the toner to prevent the toner in the developer container 120 from entering the end seal 400. The charge polarity will be described later. In the present example, polyester fiber materials are used for the warp threads 402*a* and weft threads 402*b* of the base fabric portion 402. In addition, polypropylene fiber materials or fiber materials mixed with carbon to improve heat dissipation may be used.

In this way, the pile fiber portion 403 that rubs against the developing roller 106 and the base fabric portion 402 that does not rub thereagainst are configured by using different fiber threads, so that the cost of the fibers used for the base fabric portion 402 can be reduced, and the cost of the end seal 400 can be reduced. Further, it is possible to form a surface layer for the purpose of improving the toner sealing performance by changing a density and a weaving method of the pile fiber portion 403. These are appropriately changed according to a target life span of the process cartridge.

The intermediate layer 407 is a layer made of an elastic body that brings the surface layer 401 into contact with the developing roller 106 at a predetermined pressure while filling the gap between the developer container 120 and the developing roller 106. For a material of the intermediate layer 407, for example, foamed polyurethane is used. The intermediate layer 407 has a thickness that can sufficiently fill the gap even if the gap between the developing frame body 121 and the developing roller 106 varies due to a dimensional tolerance and an assembly tolerance of each portion. In the present example, for the intermediate layer 407, a synthetic resin foam obtained by adding carbon having heat dissipation to polyurethane foam is used. In addition thereto, for example, a rubber material such as polystyrene, polypropylene, elastomer, or natural rubber may be used.

The intermediate adhesive layer 406 is an adhesive layer that fixes the base fabric portion 402 to the intermediate layer 407. It is not limited to a specific configuration as long as it can fix them without impairing sealing performance of the base fabric portion 402 and repulsive force performance of the intermediate layer 407. In the present example, the fixation is performed with a thermoplastic resin sheet, a double-sided tape, hot melt, a curable coating agent made of a synthetic resin, or the like.

The container adhesive layer 408 is an adhesive layer for fixing the end seal 400 to the developer container 120 to be assembled. Here, the intermediate layer 407 may be fixed to the developer container 120 without impairing the repulsive force performance. The fixation is performed with a double-sided tape or hot melt.

Further, the end seal 400 is provided with the notch portions 409, 410, and 411 for hot melt adhesion for filling a gap between the developing blade 130 disposed in the developer container 120 and the sheet member 210 with the sealing portions HM1 and HM2 made of the hot melt resin. The configurations of the sealing portions HM1 and HM2 are as described above. As shown in FIG. 15, the hot melt resin for forming the sealing portions HM1 and HM2 is injected after the end seal 400, the developing blade 130, and the sheet member 210 are assembled. In order to fill the gap, a flow method and a flow amount may be adjusted by setting materials, temperature conditions, injection conditions, and the like of the hot melt resin, or by changing notch shapes of the notch portions 409, 410 and 411 for hot melt adhesion, thereby filling the gap.

Charge property and Sealing Performance of Surface Layer Fiber of End Seal

A configuration for returning the toner that has penetrated into the surface layer 401 of the end seal 400 to the inside of the developer container 120 to prevent toner leakage will be described with reference to FIGS. 16 and 17. FIG. 17 is an enlarged view of the driving side in FIG. 15 (a perspective view after assembly). As described above, the surface layer 401 of the end seal 400 is configured of the base fabric portion 402 and the pile fiber portion 403 which is pile-woven and in which the fiber threads are in the state of standing. Also, when it abuts the developing roller 106, the pile fiber portion 403 abuts and is rubbed on the developing roller 106. As described above, for the fiber threads used for the pile fiber portion 403, the first fiber threads 404 having the same charge property as the toner polarity and the second fiber threads 405 having the charge property opposite to the toner polarity are used. In addition, when the pile fiber portion 403 is viewed from the side on which the developing roller 106 is disposed, the first fiber threads 404 and the second fiber threads 405 are woven to be alternately disposed in stripe shapes at regular intervals with respect to the rotating direction DK of the developing roller 106. Here, the layer thickness of the toner carried on the developing roller 106 is regulated by the elastic member 130*b* serving as a layer thickness regulating portion of the developing blade 130.

On the other hand, as shown in FIG. 17, a container inner end (an end seal inner end) DA of the driving side end seal 400*g* is located on a longitudinally inner side a developing blade end DB. The elastic member 130*b* of the developing blade 130 is sandwiched between the end seal 400 and the developing roller 106, and the elastic member 130*b* and the end seal 400, the end seal 400 and the developing roller 106, and the developing roller 106 and the elastic member 130*b* abut each other. For that reason, the toner in the developer container 120 is sealed in the container by the container inner end DA of the driving side end seal 400*g*. That is, in this state, the toner is carried on the developing roller 106 on a longitudinal inner side of the container inner end DA of the driving side end seal 400*g*. Also, a region used for image formation is set inward from an end RA of the toner conveying roller 107. For that reason, it is possible to perform good image formation in a toner carrying region of the developing roller 106 up to the container inner end DA of the driving side end seal 400*g* disposed on the longitudinal outer side from the end RA of the toner conveying roller 107.

Here, when the image formation is repeated and a rotation time of the developing roller 106 increases, the toner carrying region of the developing roller 106 may gradually move from the container inner end DA of the driving side end seal 400*g* to the developing blade end DB. The developing blade 130 has the elastic member 130*b* as a layer thickness regulating portion having a predetermined thickness, and in the present example, a stainless sheet metal having a thickness of about 0.1 mm is used for the elastic member 130*b*. At the container inner end DA of the end seal 400, a thickness step of the elastic member 130*b* is generated at a tip portion 430 of the elastic member 130*b* sandwiched between the end seal 400 and the developing roller 106. For that reason, as shown in FIG. 22, a minute gap SK (a minute gap SK1R in FIG. 24) is formed between the end seal 400, the developing roller 106, and the elastic member 130*b*. As shown in FIG. 24, such a minute gap is also formed between the non-driving side end seal 400*ng*, the developing roller 106, and the elastic member 130*b* (a minute gap SK1R).

Depending on the materials and filament diameters of the fiber threads of the pile fiber portion 403 of the end seal 400 and the material and hardness of the developing roller 106, an amount of the gap formed by the step portion of the elastic member 130*b*, the developing roller 106, and the surface layer 401 of the end seal 400 varies. In addition, if the gap is not filled with the pile fiber portion 403, the toner may penetrate therethrough. Further, the toner may reach the developing blade end DB through the gap at the tip of the elastic member 130*b*. That is, although the tip portion of the elastic member 130*b* of the developing blade 130 is sandwiched between the developing roller 106 and the end seal 400, the toner can penetrate through a minute gap formed by the thickness step. Accordingly, when the developing roller 106 rotates in accordance with the image forming operation, the toner may gradually penetrate into a developer carrying region of the developing roller 106 to the developing blade end DB.

Also, a life span for development may be short, the toner may not penetrate to the longitudinal outer side of the end seal inner end DA depending on the materials or the like of the pile fiber portion 403 and the developing roller 106 described above, and the toner penetration may stop between the end seal inner end DA and the developing blade end DB. At the time of image formation, the toner on the end seal 400 that has penetrated longitudinally outward from the end seal inner end DA is carried on the developing roller 106 with the layer thickness regulated by the developing blade 130. However, unlike an image forming region, an amount of toner carried on the developing roller 106 changes depending on an amount of toner that has penetrated longitudinally outward from the end seal inner end DA. Further, the toner is not consumed outside the image forming region. In this case, when the developing roller 106 rotates, the toner on the developing roller 106, the toner that has penetrated between the developing roller 106 and the tip portion 430 of the elastic member 130*b*, and the toner wiped from the developing roller 106 to the pile fiber portion 403 of the end seal 400 are rubbed between the pile fiber portion 403 of the surface layer 401 of the end seal 400 and the developing roller 106.

Also, in the manner of a cleaner system, it is possible to return the residual toner transferred to the photosensitive drum 104 for image formation to the developing roller 106 side. In the case of this manner, the toner is more easily wiped off onto the surface layer 401 of the end seal 400. If rubbed as it is, the toner in the region between the end seal inner end DA and the developing blade end DB deteriorates or melts due to frictional heat to be fused together. Further, the toner may be fused to the pile fiber portion 403, the developing roller 106, or the tip portion 430 of the elastic member 130*b* of the developing blade 130.

In addition, in this state, if the toner further penetrates and the toner fusion becomes bloated as described above, regulating failure may occur in which regulating of the layer thickness of the toner layer is performed properly on the developing roller 106. Further, in the surface layer 401 of the end seal 400, the toner may penetrate further longitudinally outward from the developing blade end DB. If the image formation is continued in this state, the penetrated toner exceeds a longitudinal outer end DC of the end seal 400 and reaches the state in which it leaks out from the process cartridge. This state is called end seal toner leakage (here, simply toner leakage).

In order to prevent the toner leakage at the end seal 400, it is required to quickly return the toner that has penetrated into the region between the end seal inner end DA and the developing blade end DB from the tip portion 430 of the elastic member 130*b* of the developing blade 130 to the inside of the developer container 120 (inward in the longitudinal direction from the container inner end DA). For that reason, it is effective to return the toner to the inside of the container using a rotational force of the developing roller 106 by forming the angle θS1 of inclined bristles toward the inner side of the developer container 120 as described above for the pile fiber portion 403 of the end seal 400. In addition, it is also effective to select a material having good slidability, heat resistance, and heat dissipation as a material of pile fibers. Also, the angle θS1 of the inclined bristles may be set in the range of about 30° to 60° toward the inner side of the developer container 120 with respect to the rotating direction DK of the developing roller 106. In the present example, it is set to 45°.

In the pile fiber portion 403 of the end seal 400 according to the present example, in addition to attaching the angle θS1 of the inclined bristles to the inner side of the developer container 120, the two types of fiber threads are used as the materials of the pile fiber portion 403. As one fiber threads, the fiber threads having the charge property that repels toner charged with a normal polarity (the first fiber threads 404 having the same charge property as the toner polarity) are used, and as other fiber threads, the fiber threads having the charge polarity that attracts the toner charged with the normal polarity (the second fiber threads 405 having the charge property opposite to the toner polarity) are used. Further, these two types of fiber threads are repeatedly disposed in a fixed arrangement in the rotating direction DK of the developing roller 106 to form the pile fiber portion 403 having a stripe arrangement.

Furthermore, they are disposed in stripes on the surface rubbed with the developing roller 106 such that a proportion of the second fiber threads 405 is 5% to 60%. This enhances a toner leakage prevention effect (a toner penetration prevention effect from the container inner end DA to the region of the developing blade end DB).

A configuration of the pile fiber portion 403 will be described. At the time of image formation, a predetermined charging voltage (a charging bias) is applied to each member. Specifically, in the present example, a DC voltage of −1100 V is applied to the charging roller 105 by a charging power supply (not shown) of the image forming apparatus main body, and the surface of the photosensitive drum 104 that abuts the charging roller 105 is uniformly charged to −550 V as a surface bias. Further, by a developing contact power supply (not shown), −400 V is applied as a charging bias to the developing blade 130 and the toner conveying roller 107, and −300 V is applied to the developing roller as a charging bias. Also, the toner is a one-component developer having a negative charge polarity. The toner in the developer container 120 and the toner regulated by the developing blade 130 and carried on the developing roller 106 are uniformly charged with a negative charging bias. As described above, information to be developed is formed as a latent image by scanning exposure of the surface of the photosensitive drum 104 with the laser light U of the laser scanner unit 14. Laser power of a scanning exposure portion on the surface is adjusted to be −150 V. After that, the toner image formed on the photosensitive drum 104 is electrostatically transferred to an intermediate transfer belt by a primary transfer apparatus, which is one of transfer members, and then transferred and fixed to the recording material by a secondary transfer apparatus, which is discharged as an image formed product.

On the other hand, in the manner of a cleaner-less system, since the transfer residual toner remaining on the photosensitive drum 104 has a photosensitive drum surface potential of −550 V, it does not adhere to the charging roller 105 charged at −1100 V and passes therethrough, and will be collected by the developing roller 106 charged at −300 V.

After that, at the time of developing again, a predetermined charging bias is applied thereto by the developing blade 130.

As shown in FIG. 17, the toner collected according to the manner of a cleaner-less system passes over the surface of the pile fiber portion 403 on the end seal 400 from the downstream side of the sheet member 210 toward the developing blade 130 due to the rotation of the developing roller 106. In this case, in order to prevent the toner leakage, it is desired to move the toner so that it returns to the inside (longitudinally inner side) of the developer container 120. Thus, the function for returning the toner to the inner side in the longitudinal direction is divided in accordance with types of fibers on the surface of the pile fiber portion 403. The toner attached to the surface of the pile fiber portion 403 is charged with a negative charging bias as described above. For the first fiber threads 404 having only the same charge property as the toner polarity, filaments (fibers) made of a single fluorine-based material such as polytetrafluoroethylene (PTFE), which has a low friction and a negative charge polarity, are used. Here, the same charge property as the toner polarity is having a property that is likely to be charged with a negative polarity (minus) side due to the friction with the toner on a charging train. That is, for the fibers having the same charge property as the toner polarity (first fibers) constituting the first fiber threads 404, fibers that cause the charging train to be in a lower level than the toner are used, and as an example of the fibers, PTFE fibers are used in the present example. For the second fiber threads 405 having the charge property opposite to the toner polarity, split fibers made of nylon and polyester are used. A ratio of charged nylon with a positive polarity, which are filaments (fibers) having the charge property opposite to the toner polarity, to charged polyester with a negative polarity, which are filaments (fibers) having the same charge property as the toner polarity, in the second fiber threads 405 are nylon 1:polyester 1 to 10. Here, the charge property opposite to the toner polarity is having a property that is likely to be charged with a positive polarity (plus) side due to the friction with the toner on the charging train. That is, for the fibers having the charge property opposite to the toner polarity (second fibers) included in the second fiber threads 405, fibers that cause the charging train to be in a higher level than the toner are used, and as an example of the fibers, nylon is used in the present example. Also, although polyester is used for fibers having the same charge property as the toner polarity (third fibers) included in the second fiber threads 405 in the present example, this is an example of the fibers that cause the charging train to be in a higher level than the fibers having the same charge property as the toner polarity (PTFE fibers) constituting the first fiber threads 404.

That is, a relationship between the fibers constituting the pile fiber portion 403 (the first fibers constituting the first fiber threads 404, the second fibers and the third fibers constituting the second fiber threads 405) and the charging train of the toner is as follows.

[Plus side (higher level)] Nylon (second fibers)>Toner>Polyester (third fibers)>PTFE (first fibers) [Minus side (lower level)]

Also, the third fibers are an arbitrary configuration. For example, depending on a proportion of the second fibers on the sliding surface of the pile fiber portion 403 with the developing roller 106 and types of the first fibers or the second fibers, the third fibers do not necessarily have to be included in the second fiber threads 405, and the charging train may be in a level equal to or lower than the first fibers.

A ratio of the fiber threads disposed in a stripe arrangement in the entire pile fiber portion 403 of the end seal 400 is set to fiber threads made of only the fibers having the same charge property as the toner polarity (first fiber threads 404) 1:fiber threads including the fibers having the charge property opposite to the toner polarity (second fiber threads 405) 1 to 5. They are woven for one width of the stripe to be 0.1 mm to 20 mm. The width may be set in consideration of how much the stripes are disposed so that all the fibers abut the developing roller 106 and the developing blade 130. Here, it is set to about 1 mm.

The toner wiped from the developing roller 106 onto the end seal 400 has a negative charge polarity and repels the PTFE fibers (first fiber threads 404) and the polyester fibers (fibers having the same charge property as the toner polarity included in the second fiber threads 405) having negative charging polarities. Here, in a case in which the toner having a negative charge polarity is wiped off on the PTFE fibers and the polyester fibers having negative charge polarities, the toner having the same polarity is hard to adhere thereto and is in a state of being easily moved due to a frictional force caused by the rotation of the developing roller 106. For that reason, the toner can be moved along portions on the fiber threads 404 and 405 due to the rotation of the developing roller 106 and the inclined bristles of the end seal 400 and can be gradually moved to return to the inside of the developer container 120. Thus, it is possible to exhibit the effect of quickly returning the toner that has penetrated from the tip portion 430 of the elastic member **130*b* of the developing blade 130 to the inside of the developer container 120. Here, the toner on the PTFE fibers and the polyester fibers is rubbed as it is due to the rotation of the developing roller 106, so that it may gradually return to the inside of the developer container 120, may be peeled off from portions on the fibers due to the rotation of the developing roller 106 and moved to different fibers, or may be further pushed in a direction of the base fabric portion 402 of the end seal 400**.

On the other hand, the toner having a negative charge polarity is mutually attracted to the nylon fibers having a positive charge polarity (fibers having the charge property opposite to the toner polarity included in the second fiber threads 405), and in a case in which the toner is wiped off on the fibers, it is likely to remain on the fibers as it is. Due to the rotation of the developing roller 106, the toner on the nylon fibers may remain as it is and be rubbed therewith, may be peeled off from the portions on the fibers due to the rotation of the developing roller 106 and moved to different fibers, or may be further pushed in the direction of the base fabric portion 402 of the seal. The toner having a negative charge polarity wiped with the fibers having a positive charge polarity is harder to move than when wiped with the fibers having a negative charge polarity, and thus in a case in which there are too many fibers having a positive charge polarity, there is a need of attention because the toner having a negative charge polarity is likely to remain.

Since the toner pushed into the base fabric portion 402 of the end seal 400 is not rubbed with the developing roller 106, it does not cause the toner leakage. However, in a case in which the toner exceeds a permissible value of the base fabric portion 402 and the toner is pushed in until it cannot be pushed in, the toner remains on the surface layer 401, causing the toner leakage. The toner that stays on the surface layer 401 of the end seal 400 and is rubbed therewith is subsequently fused due to frictional heat, and from there, it may cause further fusion at the same time, which may cause the toner leakage. Further, the toner fused to the developing blade 130 moves and is sandwiched, resulting in toner regulating failure on the developing roller 106, and thus the developing roller 106 may carry a large amount of toner, which induces the toner leakage. Accordingly, it is required to pay close attention to the distribution of the fibers having the charge property opposite to the toner polarity and the fibers having the same charge property as the toner polarity.

Here, as described above, the toner having a negative charge polarity and each fiber come into contact with each other and rub against each other. As a characteristic of charge polarity friction, it is known that the toner on the fibers having the same charge property as the toner polarity, such as the PTFE fibers and the polyester fibers, may gradually reverse its polarity and change to the toner having a positive charge polarity due to repeated friction. The toner on the end seal 400 and the toner on the developing roller 106 pass through the developing blade 130 in accordance with the rotation of the developing roller 106 and thus is stably charged with a negative charging bias. For that reason, although most toners have a negative charge polarity, some of them are inverted and changed to the toner having a positive charge polarity. For the toner having a negative charge polarity, the polyester fibers (fibers having the same charge property as the toner polarity included in the second fiber threads 405) have relatively close charge polarities (their levels are close thereto in the charging train), and thus they are difficult to reverse their polarities, but in rare cases, they are reversed. The PTFE fibers (first fiber threads 404) have stronger negative charge polarities than the toner and the polyester fibers (fibers having the same charge property as the toner polarity included in the second fiber threads 405) (their levels in the charging train are separated toward a lower side than the polyester with respect to the toner). For that reason, the PTFE fibers are strongly positively charged and polarized when the toner is reversely polarized. For that reason, since the toner having a stronger positive charge polarity is likely to stay on the fibers having a negative charge polarity, it is required to pay attention to the use distribution of the PTFE fibers (first fiber threads 404). The toner that has been inverted and attracted onto the fibers may move or stay due to a frictional force caused by the rotation of the developing roller 106.

In the case of the end seal 400 that is not disposed in stripes, there is more toner having a normal negative charge polarity than the toner having a reversed positive charge polarity in the toner having a negative charge polarity, and thus in order to actively return the toner having a normal negative charge polarity to the inside of the developer container 120, fibers having a negative charge polarity are often used. Further, when the process cartridge of the image forming apparatus has a long durable life span and rotates at higher speed, fluorine-based PTFE fibers that have better slipperiness and higher heat resistance are selected, but as described above, they may have an adverse effect on the reversed toner.

On the other hand, by performing the stripe arrangement using nylon having a positive charge polarity that has the charge property opposite to the toner polarity (fibers having the charge property opposite to the toner polarity included in the second fiber threads 405), it can repel the reversed toner and return it to the inside of the developer container 120. Thus, it is possible to support a longer life span and higher-speed rotation. The toner returned to the inside of the developer container 120 passes through the developing blade 130 again, and thus is stably charged with a negative charging bias and reused.

Also, in the present example, in the pile fiber portion 403 that rubs against the developing roller 106, specifically, the stripe arrangement is performed such that the ratio of the fiber threads 405 having the same charge property as the toner polarity described above is 5% to 60%. This ratio is satisfied in a sliding contact region (the seal regions 106M2R and 106M2L) of the end seal 400 with the developing roller 106. In addition, the ratio of the fiber threads disposed in the stripe arrangement in the entire pile fiber portion 403 of the end seal 400 is set to fiber threads only having the same charge property as the toner polarity (first fiber threads 404) 1:fiber threads including the fibers having the charge property opposite to the toner polarity (second fiber threads 405) 1 to 5. It is preferable that each ratio be determined from the viewpoint of sealing performance and cost.

Figure 25B:
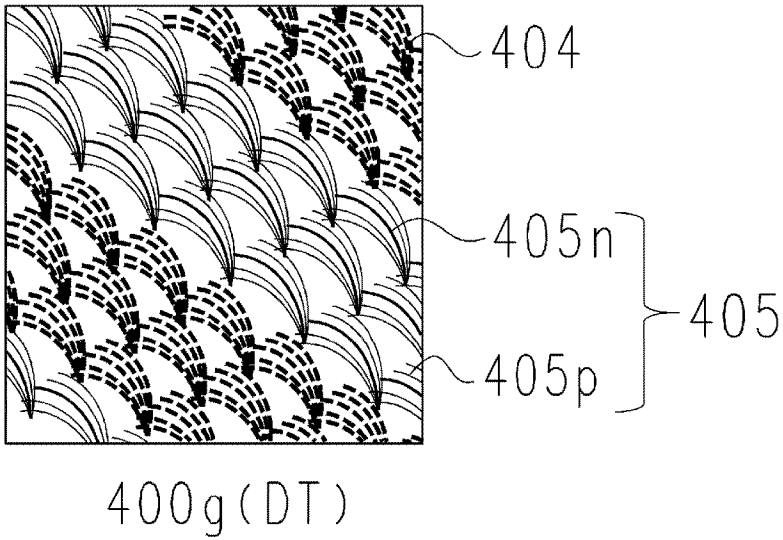
FIGS. 25A and 25B are explanatory diagrams of a method for acquiring ratios of fibers on a seal surface of the end seal.
Figure 25A:
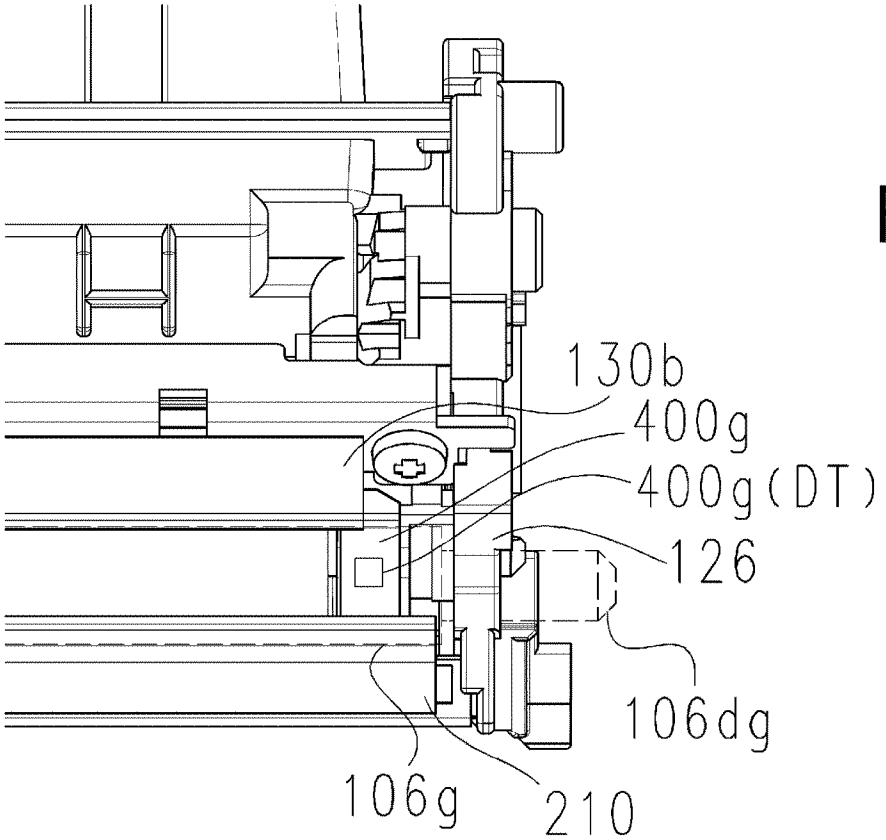

FIGS. 25A and 25B are schematic views for describing an example of a method for acquiring ratios of various fibers on the seal surface of the driving side end seal 400*g*. FIG. 25A is a front view schematically showing a vicinity of the driving side end of the developing unit and shows a state when a detection developing roller 106*g* made of a transparent material (for example, acrylic, glass, or the like) for detecting ratios of fibers is assembled to the developing unit instead of the normal developing roller 106. The detection developing roller 106*g* has the same diameter as the developing roller 106, and shaft portions 106*dg* at both longitudinal ends thereof are pivotally supported by the driving side bearing 126 and pressed against the seal surface of the driving side end seal 400*g*. In a state in which the detection developing roller 106*g* is pressed against the driving side end seal 400*g*, a predetermined range of a contact surface (a seal surface) of the driving side end seal 400*g* with an outer circumferential surface of the detection developing roller 106*g* is photographed from an inner side (an inner cylindrical portion side) of the transparent detection developing roller 106*g*. FIG. 25B is a schematic enlarged view showing a detection range 400*g*(DT) in the driving side end seal 400*g* shown in FIG. 25A. As shown in FIG. 25B, in the predetermined detection range 400*g*(DT), tilted states of PTFE fibers, which are the first fiber threads 404, and polyester fibers 405*p* and nylon fibers 405*n*, which are the second fiber threads 405, in a tilting direction of bristles due to pressure contact with an outer circumferential surface of the detection developing roller 106*g* are photographed. The photographed image of the detection range 400*g*(DT) can be converted into an image for detection in which each fiber is color-coded for each type and displayed by performing image processing, for example. Also, in a case in which the color of each fiber is a combination in which a difference in color can be clearly visible, the image processing may not be performed. By acquiring an area ratio of the color of each fiber in the image for detection, ratios of various fibers on the seal surface of the driving side end seal 400*g* can be acquired. Also, the method for acquiring the ratios of fibers on the seal surface described here is merely an example, and other methods may be used as appropriate. For example, when the toner is spilled on the seal surface of the driving side end seal 400*g*, the developing roller 106 is pressed against the seal surface, and the developing roller 106 is separated from the seal surface, an attached state of the toner remaining on the seal surface is observed so that the ratios of fibers can also be acquired.

As described above, the filaments having the same charge property as the toner polarity (the fibers constituting the first fiber threads 404 and the fibers having the same charge property as the toner polarity included in the second fiber threads 405) usually promote the movement of the toner and are likely to attract the reversed toner. On the other hand, the filaments having the charge property opposite to the toner polarity (the fibers having the charge property opposite to the toner polarity included in the second fiber threads 405) are likely to attract the normally charged toner, but can promote the movement of the reversed toner.

In the present example, since the fluorine-based PTFE fibers used in the first fiber threads 404 have better slipperiness and durability than the polyester fibers serving as the fibers having the same charge property as the toner polarity included in the second fiber threads 405, they are desired to be actively used, but the cost is high. For that reason, in order to reduce the cost, a ratio of PTFE fibers (the first fiber threads 404) is lowered, a ratio of split fibers composed of polyester fibers and nylon fibers (the second fiber threads 405) is increased, and the ratios are set to PTFE fibers 1:split fibers 3 to 5, and thus it is possible to reduce the cost. In that case, since a ratio of the reversed toner decreases, it is preferable to select the split fibers that reduces the number of filaments having the charge property opposite to the toner polarity as the second fiber threads 405. Specifically, it is preferable that the nylon fibers serving as the fibers having the charge property opposite to the toner polarity included in the second fiber threads 405 be set to about at least 10% and not more than 20%. It is preferable to avoid the case of not more than 5% since there is a risk of not abutting the tip portion 430 of the elastic member 130*b* of the developing blade 130 described above.

On the other hand, in the case of a cartridge and a developing unit that supports a long life span and a higher speed, by increasing the ratio of the PTFE fibers to be set to PTFE fibers (first fiber threads 404) 1:split fibers (second fiber threads 405) 1 to 2, good sealing performance can be obtained. In this case, since an amount of the reversed toner increases, it is preferable to select split fibers that increase the number of filaments having the charge property opposite to the toner polarity. Specifically, it is preferable that the nylon fibers (fibers having the charge property opposite to the toner polarity included in the second fiber threads 405) be about at least 40% and not more than 60%. It is preferable to secure 40% as a lower limit value to ensure an attracting action for the toner. Also, it is preferable to avoid the case of exceeding 60% because, normally, the toner is easily attracted and is collected too much on the surface layer 401 of the end seal 400, which is likely to lead to toner fusion and toner leakage. In addition, since variations also occur depending on thicknesses and lengths of fibers, it is preferable to determine the ratios while checking wiping performance and toner moving performance on the end seal 400.

From the above, it is preferable that the ratio of the second fiber threads 405 included in the sliding contact region of the pile fiber portion 403 with the developing roller 106 be at least 5%. An upper limit thereof is preferably not more than 20%. When it exceeds 20%, the influence of the second fiber threads 405 that attract the toner tends to be large, and the range of not more than 20% is a preferable upper limit value from the viewpoint of surely obtaining the effect of the present invention.

However, by appropriately setting materials of the fibers constituting the second fiber threads 405 and a composition ratio of the split fibers, an upper limit value of not more than 60% may be allowed as long as the toner attraction performed by the second fiber threads 405 is not excessive. This is because if it exceeds 60%, the influence of the second fiber threads 405 that attract the toner becomes too large. For example, in the case of setting the upper limit value between at least 40% and not more than 60%, it is preferable to inhibit an attractive force of the toner within a suitable range by appropriately setting types of the fibers having the charge property opposite to the toner polarity included in the second fiber threads 405 (second fibers) and types and ratios of the fibers having the same charge property as the toner polarity included in the second fiber threads 405 (third fibers). For example, by increasing the proportion of the third fibers (polyester) in the second fiber threads 405 and decreasing the proportion of the second fibers (nylon), the effect of the charge property opposite to the toner polarity of the second fiber threads 405 (toner attraction effect) can be kept in a suitable range.

That is, the proportion of the second fiber threads 405 in the sliding contact region with the developing roller 106 in the pile fiber portion 403 is preferably at least 5% and not more than 60%, and more preferably at least 5% and not more than 20%.

Also, the combinations and proportions of the fibers having the charge property opposite to the toner polarity (second fibers) and the fibers having the same charge property as the toner polarity (third fibers) in the second fiber threads 405 are not limited to the above. For example, depending on the proportions of the first fiber threads 404 and the second fiber threads 405, that is, in a case in which the ratio of the second fiber threads 405 to the first fiber threads 404 is made as small as possible, the second fiber threads 405 may be made of only the fibers having the charge property opposite to the toner polarity (second fibers).

Further, in the present example, the first fiber threads 404 are made of only the first fibers having the same charge property as the toner polarity, but fibers having a different material or the like from the fibers may be included as the fibers constituting the first fiber threads 404. Similarly, in the present example, the second fiber threads 405 are made of only the second fibers and the third fibers, but fibers having different materials or the like from the second fibers and the third fibers may be included as the fibers constituting the second fiber threads 405.

Further, on the seal surface (surface layer 401) of the end seal 400 that is in sliding contact with the developing roller 106, the strip-shaped first seal region configured of only the first fiber threads 404 and the strip-shaped second seal region configured of only the second fiber threads 405 are alternately disposed in stripe shapes. From the viewpoint of sufficiently obtaining the effects of the present invention, it is preferable that the number of repetitions of the stripes be set such that each of the first seal region and the second seal region is repeated at least twice or more. There is a high possibility that once will not sufficiently exhibit the effects of the present invention. Widths of each stripe, inclination angles of stripes with respect to the rotating direction of the developing roller 106, and the like are appropriately set so that repetitions of such stripes can be made. Also, the seal surface (surface layer 401) of the end seal 400 may include a seal region other than the first seal region and the second seal region described above.

Further, in the present example, the heights of the first fiber threads 404 and the second fiber threads 405 from the base fabric portion 402 (heights when not attached to the developing frame body 121) are the same as each other, but the heights are not limited thereto. For example, by making the heights of the second fiber threads 405 that attract the toner lower than the heights of the first fiber threads 404 that repel the toner, it becomes easier to collect the toner toward the second fiber threads 405. Thus, when the toner that has penetrated into the sliding surface of the end seal 400 on the developing roller 106 returns to the inside of the developer container 120, the striped portions of the second fiber threads 405 can function like guide grooves for returning the toner to the inside of the developer container 120.

Further, in the container inner end DA of the end seal 400, the toner may penetrate to a portion other than the tip portion 430 of the elastic member 130*b* of the developing blade 130. For example, the toner may slightly penetrate from an end face 431 or the sheet member 210 in contact with an inner side of the developer container 120 due to the tilting direction of the bristles or the thickness step of the pile fiber portion 403 of the surface layer 401 of the end seal 400. That is, the toner may penetrate into the seal regions 106M2R and 106M2L between the outer circumferential surface 106S of the developing roller 106 and the end seals 400. However, since the gaps that may be formed in the seal regions 106M2R and 106M2L are smaller than the gaps formed by the tip portion 430 of the elastic member 130*b* of the developing blade 130 and the end seals 400 described above, a penetration amount of the toner is very small, and the toner can be returned to the inside of the developer container 120 and reused by the method described above. Also, the toner may also penetrate into the minute gaps between the driving side end seal 400*g*, the developing roller 106, and the sheet member 210 (the minute gap SK2R), and between the non-driving side end seal 400*ng*, the developing roller 106, and the sheet member 210(the minute gap SK2L). However, the sheet member 210 is located on the upstream side of the outer circumferential surface region 106SI of the developing roller 106 exposed to (facing) the developing space 123 of the developer container 120 in the rotating direction of the developing roller 106. In addition, the sheet member 210 extends longitudinally outward over the end seals 400 in the longitudinal direction, and the longitudinal end portions of the sheet member 210 are located outward from the outer end portions of the end seals 400 in the longitudinal direction. For that reason, the influence of the toner penetrating into the minute gaps SK2R and SK2L is smaller than the influence of the toner penetrating into the minute gaps SK1R and SK1L on the developing blade 130 side.

End Seal Width in Manner of Cleaner-Less System

FIG. 18 is a schematic view for describing the longitudinal width of the end seal 400 and is an exploded view showing positional relationships thereof with constituent members assembled to the process cartridge in the longitudinal direction. Here, a longitudinal position (an end seal width) of the end seal 400 with respect to the photosensitive drum 104 and the charging roller 105 when configured as the process cartridge in the configuration of FIG. 18 described above will be described.

As described above, the charging roller 105 is configured of a charging portion 420 that comes into contact with the photosensitive drum 104 to charge it, and a rotation support portion 421 that is supported by the first drum frame body portion 115 for being rotationally driven in contact with the photosensitive drum 104. Here, although the driving side will be described, the non-driving side at the other end has the same configuration. As shown in FIG. 18, a position of the charging portion 420 in the longitudinal direction of the charging roller 105 that comes into contact with and charge the photosensitive drum 104 reaches a charging roller charging portion end CA. This is for surely charging the photosensitive drum 104 in a range up to or over the developing blade end DB that regulates the toner carried on the developing roller 106 at the time of image formation. That is, the charging roller charging portion end CA at a longitudinal end of the charging portion 420 of the charging roller 105 is configured to be longer outward in the longitudinal direction than the developing blade end DB. In this case, the end seal 400 is located further outward in the longitudinal direction, and a region reaching the longitudinal outer end DC of the end seal is within the range on the end seal 400. In the manner of a cleaner-less system, when the transfer residual toner remaining on the photosensitive drum 104 is collected in the developer container 120, normally, the range in which the toner is coated on the developing roller 106, that is, the range reaching the longitudinal end of the developing blade 130 is the range in which the transfer residual toner remains on the photosensitive drum 104.

Here, in order to form a good image, the charging region of the charging roller 105 is extended further outward in the longitudinal direction. For that reason, the transfer residual toner on the photosensitive drum 104 may also reach a charging end due to vibrations of the main body or the cartridge during image formation, vibrations caused by abutment between the photosensitive drum 104 and the developing roller 106, and the like. For that reason, the residual toner on the photosensitive drum 104 adhering to the charging end is developed and collected, and then collected onto the end seal 400. As described above, the transfer residual toner can be returned to the developer container 120 by the end seal 400 having the stripe arrangement. For this reason, it is preferable to set the width of the end seal 400 (the longitudinal outer end of the end seal) to be longer than the charging roller charging portion end CA of the charging portion 420 of the charging roller 105. This makes it possible to prevent the toner leakage even in a configuration using the manner of a cleaner-less system.

Also, the surface layer 401 of the end seal 400 in the present example is configured such that the pile fiber portion 403 in which the fiber threads stand is in contact with the developing roller 106 in consideration of adhesion to the developing roller 106, but the present invention is not limited to such a configuration and may be configured in consideration of adhesion and slidability. For example, in addition to the pile weaving, a configuration of performing sealing only with the warp threads 402*a* and the weft threads 402*b* of the base fabric portion 402, a configuration of knitting each fiber thread, or a configuration of entwinning and crimping fiber threads may be used. In this case, as described above, it is required to use fiber threads having the same charge property as the toner polarity and fiber threads having the charge property opposite to the toner polarity for the charge polarity of the toner to be used. Further, even for the toner whose charge polarity is reversed by disposing different fiber portions such that they are disposed in stripes in the rotating direction of the developing roller, it is possible to prevent the toner leakage by returning the toner to the inside of the developer container 120. Also, as described above, it is desirable to dispose fiber portions having angles of inclined bristles that makes it easy to move the toner toward the inside of the developer container 120 in the rotating direction of the developing roller 106 in stripes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-139127, filed on Aug. 27, 2021, which is hereby incorporated by reference herein in its entirety.

What is claimed is:

1. A developing unit comprising:

a frame body including a storage chamber in which a developer is stored, and an opening portion communicating with the storage chamber;

a developing roller rotatably supported by the frame body to rotate around a rotation axis thereof, the developing roller facing the opening portion; and a seal member provided on a portion of the frame body outside the opening portion in the rotation axis direction, the seal member extending along a rotating direction of the developing roller and including a seal surface that comes into contact with and slides with an end portion of an outer circumferential surface of the developing roller in the rotation axis direction, wherein the seal surface includes a first seal region having a stripe shape and a second seal region having a stripe shape, the first seal region includes a plurality of first fiber bundles including a first fiber having a charge property that repels the developer charged with a normal polarity, the second seal region includes a plurality of second fiber bundles including a second fiber having a charge property that attracts the developer charged with the normal polarity, both of the first seal region and the second seal region extend in an inclined direction such that a portion thereof closer to the opening portion in the rotation axis direction is located further downstream in the rotating direction of the developing roller, the first seal region and the second seal region are alternately disposed in the rotating direction, and a proportion of a portion occupied by the second fiber bundles on the seal surface is at least 5% and not more than 60%.

2. The developing unit according to claim 1, wherein the second fiber bundles include a third fiber having a charge property that repels the developer charged with the normal polarity, a level of the charge property of the third fiber in a charging train being closer to a charge property of the developer than that of the first fiber.

3. The developing unit according to claim 1, wherein a ratio of the second fiber to the third fiber in the second fiber bundles is 1:1 to 10.

4. The developing unit according to claim 1, wherein the seal surface further includes a base fabric portion constituted by warp threads and weft threads, wherein the first fiber bundles and the second fiber bundles are woven between the warp threads and the weft threads to stand on the base fabric portion.

5. The developing unit according to claim 4, wherein the first fiber bundles stand on the base fabric portion such that tip sides thereof tilt in the extending direction of the first seal region with respect to base sides thereof woven into the base fabric portion, and the second fiber bundles stand on the base fabric portion such that tip sides thereof tilt in the extending direction of the second seal region with respect to base sides thereof woven into the base fabric portion.

6. The developing unit according to claim 4, wherein, in a state in which the seal member is not attached to developing unit, heights of the second fiber bundles from the base fabric portion are the same as heights of the first fiber bundles from the base fabric portion, or lower than the heights of the first fiber bundles from the base fabric portion.

7. The developing unit according to claim 4, wherein a surface of the seal member on a side opposite to the seal surface is an adhesive surface bonded to the frame body, and the seal member includes:

a surface layer including the seal surface and the base fabric portion;

an intermediate layer made of an elastic material;

an intermediate adhesive layer between the surface layer and the intermediate layer; and a frame body adhesive layer between the intermediate layer and the frame body.

8. The developing unit according to claim 1, further comprising a regulating member for regulating a layer thickness of the developer carried on the circumferential surface of the developing roller, wherein the seal member includes a sandwiching seal surface that sandwiches a tip of the regulating member together with the outer circumferential surface of the developing roller on a downstream side of the seal surface in the rotating direction of the developing roller.

9. The developing unit according to claim 1, wherein a proportion of a portion occupied by the second fiber bundles on the seal surface is at least 5% and not more than 20%.

* * * * *